US008549666B2

(12) United States Patent
Gheneva

(10) Patent No.: US 8,549,666 B2
(45) Date of Patent: Oct. 8, 2013

(54) CONVERTIBLE GARMENT

(75) Inventor: Dobriana Gheneva, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 12/893,029

(22) Filed: Sep. 29, 2010

(65) Prior Publication Data

US 2011/0016603 A1 Jan. 27, 2011

Related U.S. Application Data

(62) Division of application No. 11/020,164, filed on Dec. 27, 2004, now Pat. No. 7,814,574.

(51) Int. Cl.
*A41B 1/00* (2006.01)
*A41D 1/18* (2006.01)

(52) U.S. Cl.
USPC ..... 2/115; 2/106

(58) Field of Classification Search
USPC ..... 2/48, 50, 51, 52, 67, 71, 86, 88, 89, 2/104, 106, 114, 115, 125, 126, 127, 269, 2/DIG. 2, 49.1; 450/30
See application file for complete search history.

(56) References Cited

U.S. PATENT DOCUMENTS 555,535 A 3/1896 Sessler
601,434 A 3/1898 Davis
719,650 A * 2/1903 Davis ..... 2/59
1,076,124 A 10/1913 Juda
1,157,265 A * 10/1915 Tutelman ..... 2/269
1,250,004 A 12/1917 Philip
1,758,740 A 5/1920 Gale
1,406,764 A 2/1922 Schwartz
1,470,849 A 10/1923 Klappert
1,488,635 A * 4/1924 Flannery ..... 2/48
1,489,046 A * 4/1924 Thompson ..... 2/114
1,505,053 A * 8/1924 Millhauser ..... 2/90
1,505,986 A 8/1924 Wellstatter
1,629,561 A 5/1927 Wellstatter
1,637,157 A 7/1927 Osborne, Jr.
1,650,386 A 11/1927 Phillips
1,692,350 A 11/1928 Robertson
1,695,590 A 12/1928 Jensen
1,731,137 A * 10/1929 Jones ..... 2/74
2,523,416 A 9/1930 Brennan
1,889,701 A 11/1932 Rosenberg
1,972,795 A 9/1934 Rieffannacht
2,080,814 A 5/1937 Foltz
2,104,826 A * 1/1938 Stramiello ..... 2/126
2,138,365 A 11/1938 Wilson
2,208,906 A * 7/1940 Leone ..... 2/71
2,211,966 A 8/1940 Attman
2,213,900 A 9/1940 Buchanan (Continued)

*Primary Examiner* — Alissa L Hoey
(74) *Attorney, Agent, or Firm* — Banner & Witcoff, Ltd.

(57) ABSTRACT

Garments are convertible between multiple configurations so as to have an alternate appearance and/or be wearable as a different type of garment. Pants may be alternately configured so as to expose one of at least two possible surface treatments. The pants include a reversing panel having front and rear flaps that can be alternately wrapped around the left or right side. A garment alternately configurable for wear as a skirt or as a pair of short pants includes front and rear conversion tails. The front conversion tail is alternately affixable to the front or to the rear of the garment; the rear conversion tail is alternately affixable to the rear or to the front of the garment. A garment is also alternately configurable for wear in a sleeveless, wraparound manner, or for wear as a sleeved garment.

7 Claims, 41 Drawing Sheets

(56) References Cited

U.S. PATENT DOCUMENTS

| | | | | | |
|---|---|---|---|---|---|
| D134,838 | S | * | 1/1943 | Epstein | D2/849 |
| 2,343,480 | A | | 3/1944 | Sansom | |
| 2,385,871 | A | * | 10/1945 | Liebert | 2/71 |
| 2,425,402 | A | | 8/1947 | Ona | |
| 2,435,422 | A | | 2/1948 | Bohr | |
| 2,446,326 | A | | 8/1948 | Guithues | |
| 2,515,089 | A | | 7/1950 | Kamhl | |
| 2,522,421 | A | | 9/1950 | Wolf | |
| 2,580,774 | A | | 1/1952 | Helbig | |
| 2,634,421 | A | | 4/1953 | Ceraulo | |
| 2,642,575 | A | | 6/1953 | Prescott | |
| 2,643,385 | A | * | 6/1953 | Engel | 2/108 |
| 2,659,893 | A | | 11/1953 | Hindman | |
| 2,744,253 | A | | 5/1956 | Freedman | |
| 2,836,826 | A | * | 6/1958 | Geiss | 2/125 |
| 2,846,687 | A | * | 8/1958 | Lippman | 2/115 |
| 2,880,731 | A | * | 4/1959 | Kendall | 450/30 |
| 2,890,460 | A | | 6/1959 | Levi | |
| 3,137,860 | A | * | 6/1964 | Bindler | 2/115 |
| 3,141,458 | A | | 7/1964 | Burbank | |
| 3,218,649 | A | * | 11/1965 | Ricter | 2/114 |
| 3,229,305 | A | * | 1/1966 | Nevitt | 2/114 |
| 3,315,274 | A | | 4/1967 | Roody | |
| 3,574,237 | A | | 4/1971 | Reynolds | |
| 3,618,139 | A | * | 11/1971 | Hugin | 2/115 |
| 3,678,514 | A | | 7/1972 | Safrit | |
| 3,710,394 | A | | 1/1973 | Trice | |
| 3,751,730 | A | * | 8/1973 | Zamist | 2/114 |
| 3,877,078 | A | | 4/1975 | Tepper | |
| 3,975,777 | A | | 8/1976 | Roy | |
| 4,062,062 | A | | 12/1977 | Basaldua | |
| 4,078,265 | A | | 3/1978 | Condit | |
| 4,104,742 | A | | 8/1978 | Rahaim | |
| 4,106,125 | A | | 8/1978 | Palumbo | |
| 4,176,408 | A | | 12/1979 | de Polo | |
| 4,190,908 | A | | 3/1980 | Herskind | |
| 4,208,743 | A | * | 6/1980 | Whitcraft | 2/104 |
| 4,280,228 | A | * | 7/1981 | Sulzmann | 2/104 |
| 4,296,498 | A | | 10/1981 | Vinson | |
| 4,389,733 | A | | 6/1983 | Boykins, Jr. | |
| 4,441,025 | A | * | 4/1984 | McCoy, Jr. | 250/516.1 |
| 4,494,248 | A | * | 1/1985 | Holder | 2/69 |
| 4,524,463 | A | * | 6/1985 | Ogden | 2/105 |
| 4,554,682 | A | * | 11/1985 | Hillquist | 2/70 |
| 4,604,761 | A | | 8/1986 | Wright | |
| 4,686,714 | A | | 8/1987 | Harley | |
| D295,575 | S | * | 5/1988 | Campbell | D2/840 |
| 4,754,500 | A | * | 7/1988 | Brucato et al. | 2/105 |
| 4,785,803 | A | * | 11/1988 | Benckhuijsen | 602/20 |
| 4,893,358 | A | | 1/1990 | Bice, Jr. | |
| 4,971,073 | A | * | 11/1990 | Schneider | 128/874 |
| 5,005,217 | A | * | 4/1991 | Bern et al. | 2/104 |
| 5,023,953 | A | * | 6/1991 | Bettcher | 2/126 |
| 5,033,125 | A | | 7/1991 | de la Villefromoy et al. | |
| 5,042,089 | A | * | 8/1991 | Carmer | 2/55 |
| 5,129,406 | A | * | 7/1992 | Magnusen et al. | 128/873 |
| 5,159,718 | A | | 11/1992 | Moyer | |
| 5,282,277 | A | * | 2/1994 | Onozawa | 2/69 |
| 5,341,515 | A | | 8/1994 | Cohen | |
| 5,535,450 | A | | 7/1996 | Melzer | |
| 5,564,123 | A | * | 10/1996 | Grassick | 2/69 |
| 5,603,123 | A | * | 2/1997 | Chupa | 2/275 |
| D378,317 | S | | 3/1997 | Wike | |
| 5,611,087 | A | * | 3/1997 | Adkins | 2/114 |
| 5,628,064 | A | * | 5/1997 | Chung | 2/70 |
| 5,636,387 | A | | 6/1997 | Lundy | |
| 5,822,793 | A | | 10/1998 | Tokura et al. | |
| 5,902,261 | A | * | 5/1999 | Schwartz | 602/61 |
| 5,930,838 | A | | 8/1999 | Carter-Scott-Pomije | |
| 5,983,392 | A | | 11/1999 | Dutka | |
| 6,006,356 | A | * | 12/1999 | Song | 2/69 |
| 6,024,091 | A | * | 2/2000 | Bennett | 128/873 |
| 6,029,279 | A | | 2/2000 | Ralston et al. | |
| 6,032,288 | A | * | 3/2000 | Simone | 2/69 |
| 6,115,847 | A | | 9/2000 | Rosch et al. | |
| 6,161,223 | A | | 12/2000 | Andrews | |
| 6,226,798 | B1 | * | 5/2001 | Le Blanc et al. | 2/69 |
| 6,237,153 | B1 | | 5/2001 | Bowens | |
| 6,282,718 | B1 | * | 9/2001 | Drakford | 2/70 |
| 6,338,666 | B1 | | 1/2002 | Ishii | |
| 6,374,414 | B1 | * | 4/2002 | Collier | 2/69 |
| 6,446,264 | B2 | * | 9/2002 | Fairhurst et al. | 2/69 |
| 6,601,239 | B2 | * | 8/2003 | Drake | 2/51 |
| 6,651,258 | B2 | | 11/2003 | Pelensky | |
| D503,513 | S | | 4/2005 | McCarthy | |
| 6,948,187 | B2 | * | 9/2005 | Drake | 2/51 |
| 7,032,249 | B2 | | 4/2006 | Smith | |
| 7,066,784 | B2 | * | 6/2006 | Peay | 450/31 |
| 7,343,629 | B2 | * | 3/2008 | Hunt | 2/93 |
| 7,650,650 | B2 | * | 1/2010 | Voege | 2/269 |
| 7,793,360 | B2 | * | 9/2010 | Blauer et al. | 2/81 |
| 7,814,574 | B2 | * | 10/2010 | Gheneva | 2/227 |
| 7,818,817 | B1 | * | 10/2010 | Owens et al. | 2/54 |
| 2003/0229930 | A1 | | 12/2003 | Carlson | |
| 2005/0132463 | A1 | * | 6/2005 | Kathumbi-Jackson et al. | 2/51 |
| 2007/0130668 | A1 | | 6/2007 | Berman et al. | |
| 2007/0157367 | A1 | | 7/2007 | Kerkhoff | |
| 2008/0092263 | A1 | * | 4/2008 | Good et al. | 2/49.1 |
| 2008/0092265 | A1 | * | 4/2008 | Gage et al. | 2/69 |

* cited by examiner

FIG. 19A
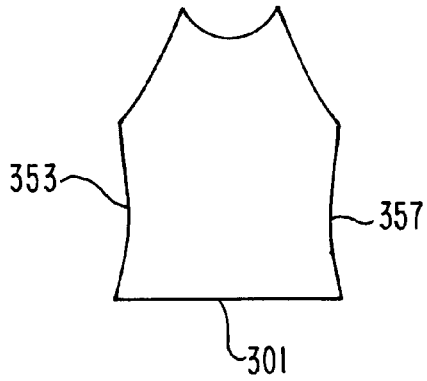
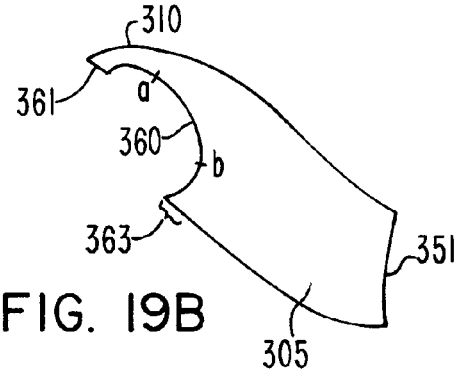
FIG. 19B
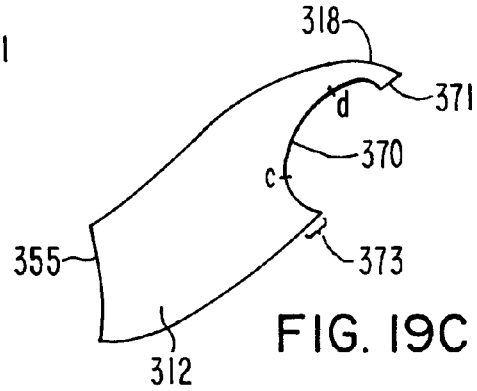
FIG. 19C
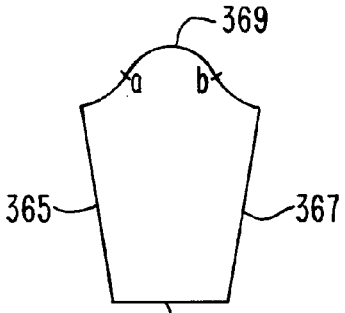
FIG. 19D
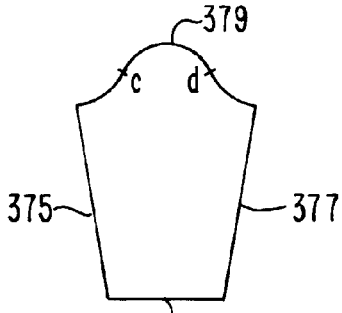
FIG. 19E

CONVERTIBLE GARMENT

RELATED APPLICATION

This non-provisional U.S. Patent Application is a divisional application and claims priority to U.S. patent application Ser. No. 11/020,164 which was filed in the U.S. Patent and Trademark Office on Dec. 27, 2004, and entitled "Convertible Garment," now U.S. Pat. No. 7,814,574, issued on Oct. 19, 2010, such prior application being entirely incorporated herein by reference.

FIELD OF THE INVENTION

This invention relates to apparel. In particular, this invention relates to articles of apparel that can be rearranged into alternate configurations so as to vary the style and/or color of a garment.

BACKGROUND OF THE INVENTION

Convertible articles of apparel, i.e., garments which can be placed in different configurations to change the appearance and/or function of a garment, are known. One of the simplest examples of such a garment is a shirt or other article which can be turned inside out so as to change the outwardly displayed color. Other examples include garments such as are described in U.S. Pat. No. 4,104,742. A garment described therein includes hook and pile fasteners which can be unfastened so as to permit reconfiguration of a pair of shorts into a skirt. However, existing convertible garments are less than satisfactory in some circumstances. For example, it is not always practical to construct a garment which can be turned inside out so as to reveal a different color. In some cases, turning a garment inside out exposes seams or stitching which may not be aesthetically pleasing. As another example, the construction described in the U.S. Pat. No. 4,104,742 may be disadvantageous for certain clothing styles. Moreover, the presence of thickened hook and pile sections in the crotch region could cause discomfort to some wearers.

Although there have been other designs for convertible articles of apparel, many such designs also have various disadvantages. Fashion tastes change quickly (and frequently), and many pre-existing convertible apparel designs may not be optimal for use with more modern clothing styles. For these and other reasons, there remains a need for additional types of convertible garments.

SUMMARY OF THE INVENTION

Embodiments of the invention address many of the challenges discussed above. In at least one embodiment, the invention includes pants which may be alternately configured so as to expose one of at least two possible surface treatments. For example, a wearer may configure the pants in a first way so as to outwardly display a first color, and may configure the pants in a second way so as to outwardly display a second color. In at least one alternate embodiment, a garment is alternately configurable for use as a skirt or as a pair of short pants. In yet another embodiment, a top is alternately configurable for wear in a sleeveless, wraparound manner, or for wear as a sleeved garment.

BRIEF DESCRIPTION OF THE DRAWINGS

The foregoing summary of the invention, as well as the following detailed description of preferred embodiments, is better understood when read in conjunction with the accompanying drawings, which are included by way of example, and not by way of limitation with regard to the claimed invention.

FIGS. 19A-19E show a pattern for fabricating the garment of FIGS. 16A-18D.

DETAILED DESCRIPTION OF THE PREFERRED EMBODIMENTS

So as to avoid confusing readers not skilled in the art of apparel manufacture, "inside" will be used instead of "wrong side" to refer to the surface of a textile material that faces the body of a person wearing a garment made from that material. Similarly, "outside" will be used instead of "right side" to refer to the surface of a textile material that faces away from the body of a person wearing a garment made from that material. "Right" and "left" refer to sides of a garment when worn (i.e., the wearer's left or right). "Attached," as used herein, includes two portions of single piece of fabric being attached by nature of their being integrally connected. "Attached" also includes (but is not limited to) two pieces of material being joined by one or more intervening pieces of textile or other material.

Figure 1A:
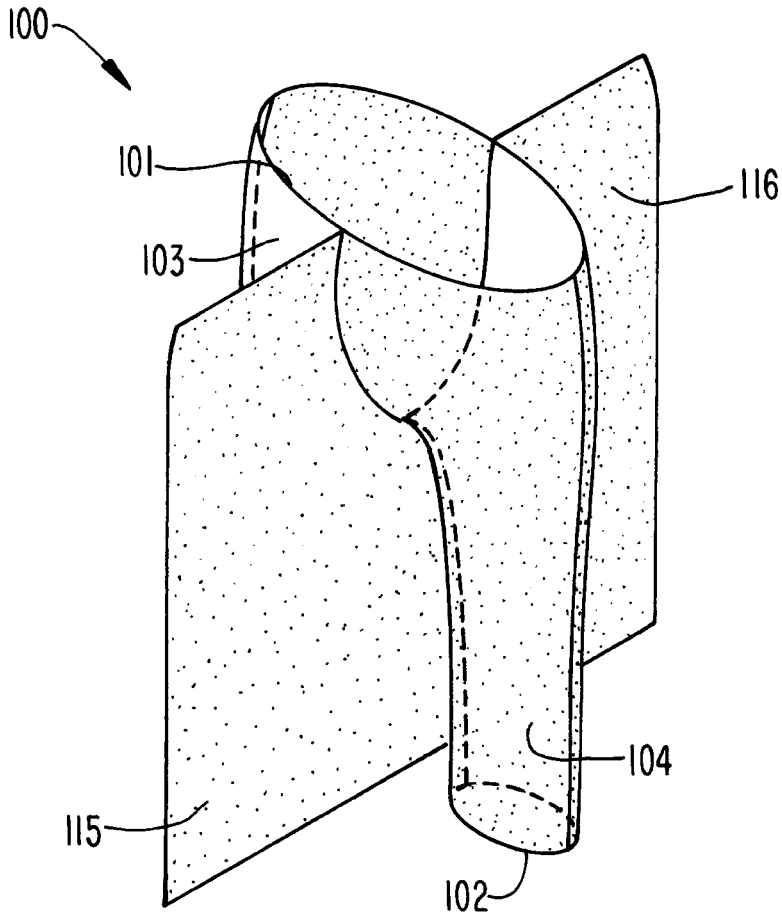
FIG. 1A is an isometric left front view of a garment according to at least one embodiment of the invention.
Figure 1B:
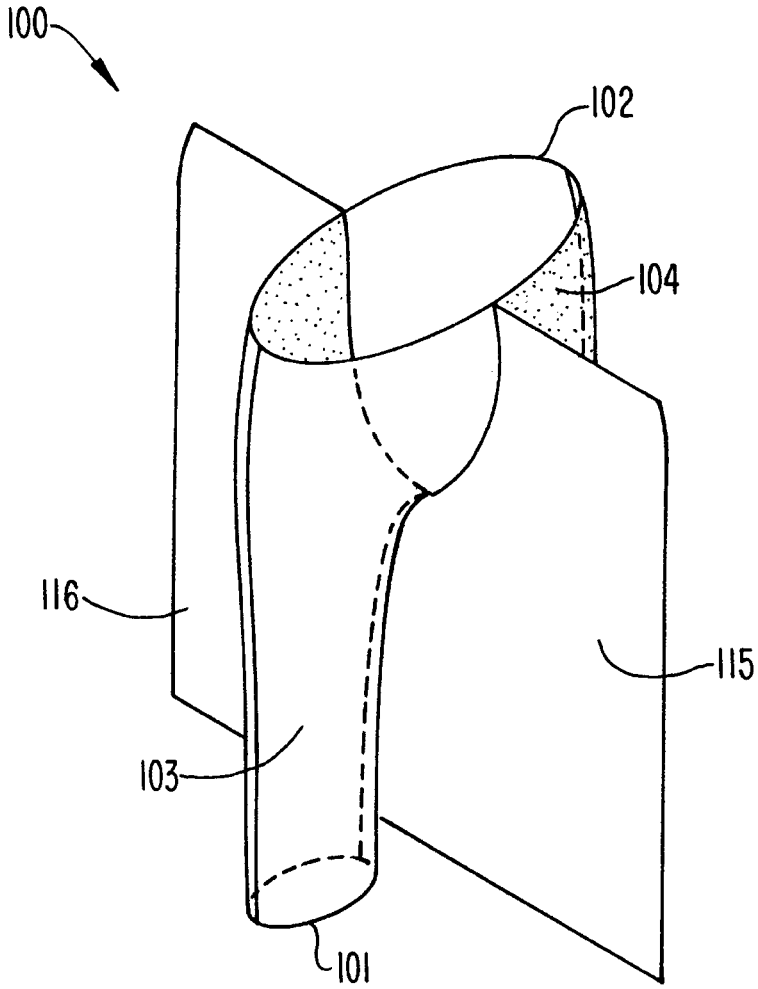
FIG. 1B is an isometric right front view of the garment of FIG. 1A.
Figure 2A:
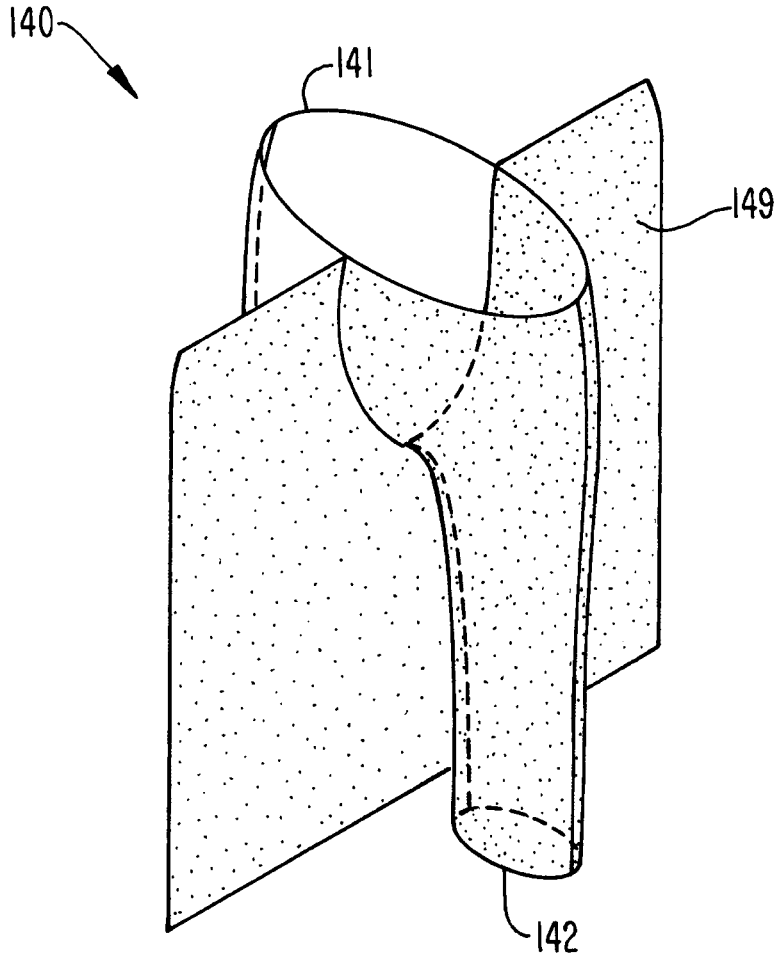
FIGS. 2A and 2B are isometric views of a garment, similar to that of FIGS. 1A and 1B, according to another embodiment of the invention.
Figure 2B:
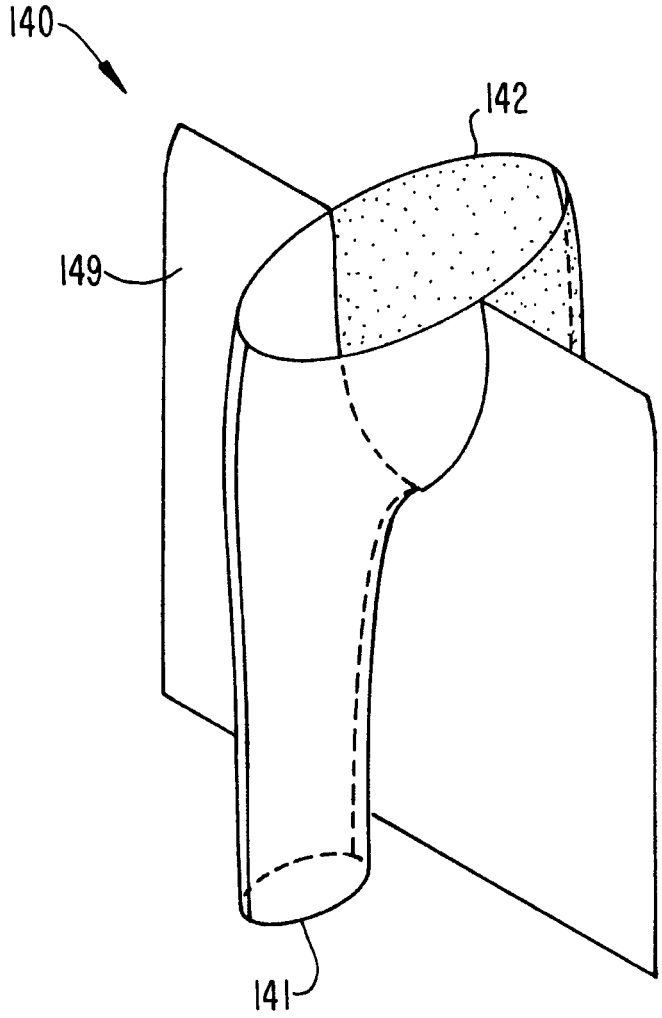

FIG. 1A is a left front isometric view of a garment 100 according to at least one embodiment of the invention. FIG. 1B is a right front isometric view of garment 100. Garment 100 includes right trouser half 101 and left trouser half 102. In at least some embodiments, one of the trouser halves has a first type of surface treatment on its outer surface 103, while the other trouser half has a different type of surface treatment on its outer surface 104. As used herein, "surface treatment" includes color, pattern, texture, adornment with objects, or other types of physical characteristics, as well as combinations of such characteristics. For convenience, stippling is used in FIGS. 1A-7C to generically indicate a first type of surface treatment, and lack of stippling is used to generically indicate a different type of surface treatment. In at least some embodiments, right and left trouser halves 101 and 102 are formed from the same type of reversible material having different surface treatments on its opposing faces. The orientation of the material surface is then reversed when constructing one of the trouser halves. In other words, a first one of the material faces is chosen as the outward surface for one of the trouser halves, and the other material face is chosen as the outward face for the other trouser half. In other embodiments, and as shown in FIGS. 2A and 2B, the trouser halves are formed from different, non-reversible materials. Trouser half 141 in FIGS. 2A and 2B is similar to trouser half 101 of FIGS. 1A and 1B, but has the same surface treatment on both the inside and outside surface. Similarly, trouser half 142 in FIGS. 2A and 2B is similar to trouser half 102 of FIGS. 1A and 1B, but has the same surface treatment on both the inside and outside surface. In some embodiments, both trouser halves have the same surface treatment on their outer surfaces.

Figure 3A:
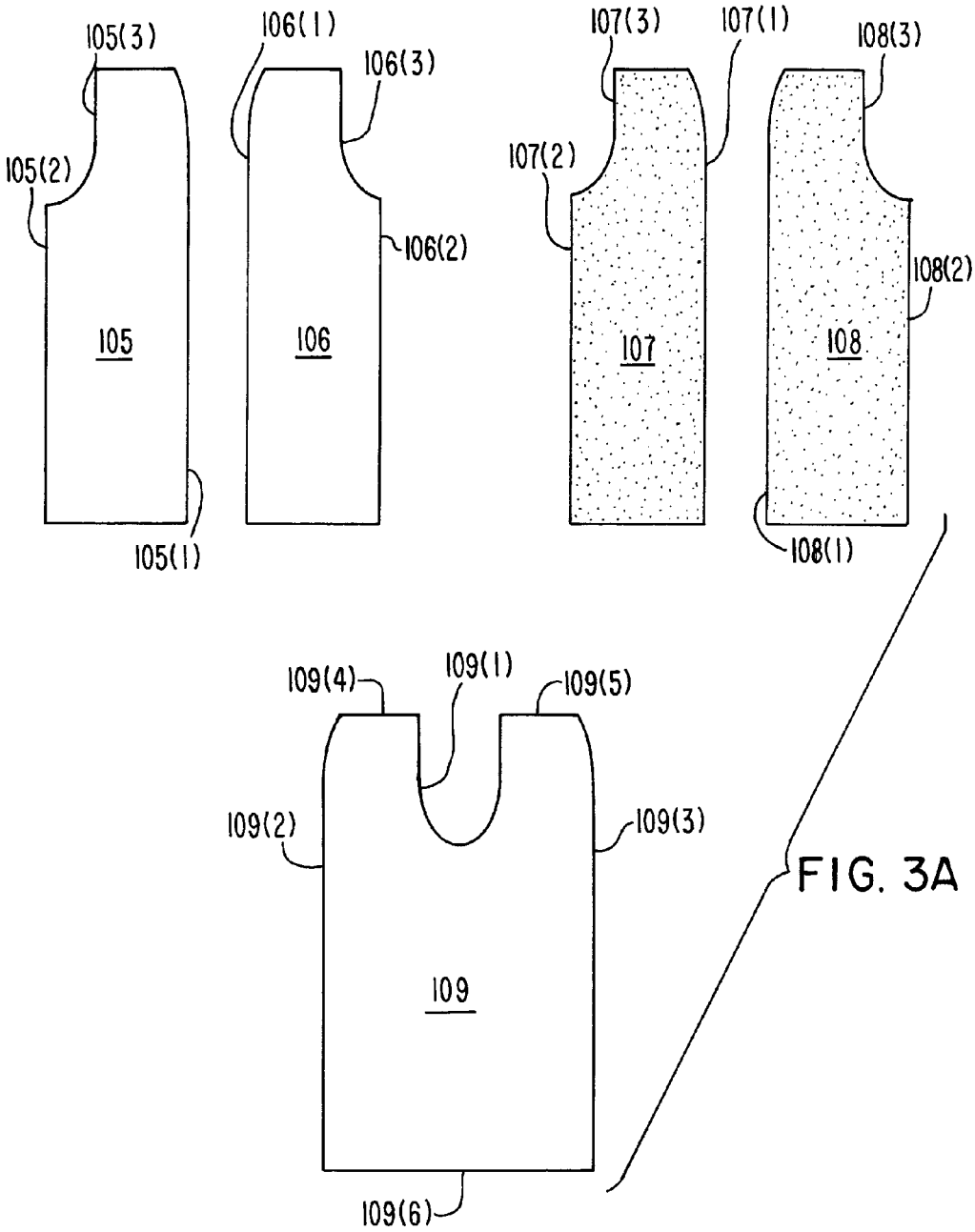
FIGS. 3A-3D show construction of the garment of FIGS. 1A and 1B.

FIGS. 3A-3D show construction of garment 100 according to at least some embodiments of the invention. FIG. 3A shows a pattern for elements of garment 100. Garment 100 is formed from right rear panel 105, right front panel 106, left front panel 107, left rear panel 108, and reversing panel 109. Each of panels 105 through 108 has side edges (numbered 1 and 2) and one half of a U-shaped cutout (numbered 3). The significance of these edges and the cutouts will be apparent in the below description and in subsequent drawing figures. Panels 105-108 are of conventional size and shape for constructing a pair of trousers. Right rear panel 105 is a mirror image of left rear panel 108, and right front panel 106 is a mirror image of left front panel 107. The outside surfaces of panels 105-108 are shown in FIG. 3A. The details of reversing panel 109 are discussed below. As described in more detail below, each surface of reversing panel 109 can become the outside surface of one of the trouser halves. In the embodiment shown, and as indicated above, panels 105-108 and 109 are cut from the same reversible material having different surface treatments on opposite faces. In this manner, only one type of material is needed for garment 100. Among other advantages, this reduces the need to stock and order multiple types of material. In other embodiments, however, and as shown in FIGS. 2A and 2B, different materials are used for each trouser half. A first material has a first surface treatment (no stippling), while a second material has a second surface treatment (stippling). The reversing flap 149 is then made from a third material having the first surface treatment on one surface (FIG. 2B) and the second surface treatment on the other (FIG. 2A).

Figure 3B:
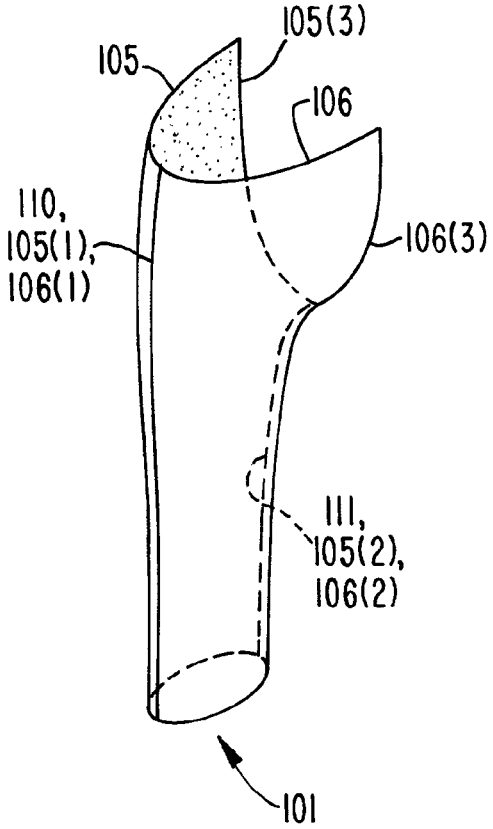
Figure 3C:
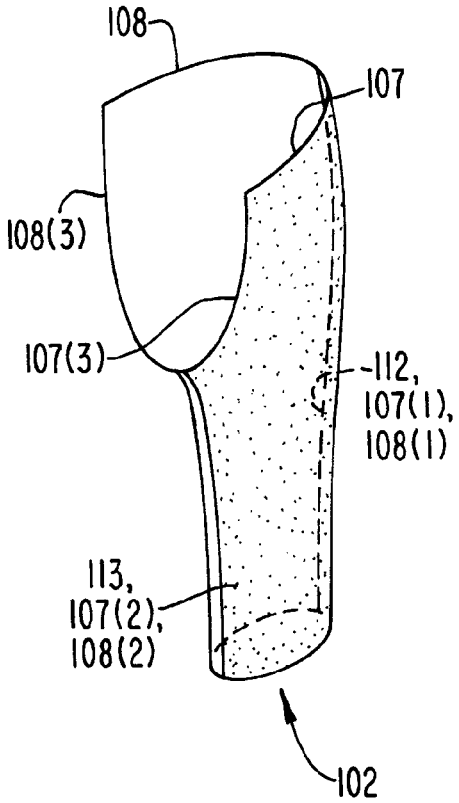
Figure 3D:
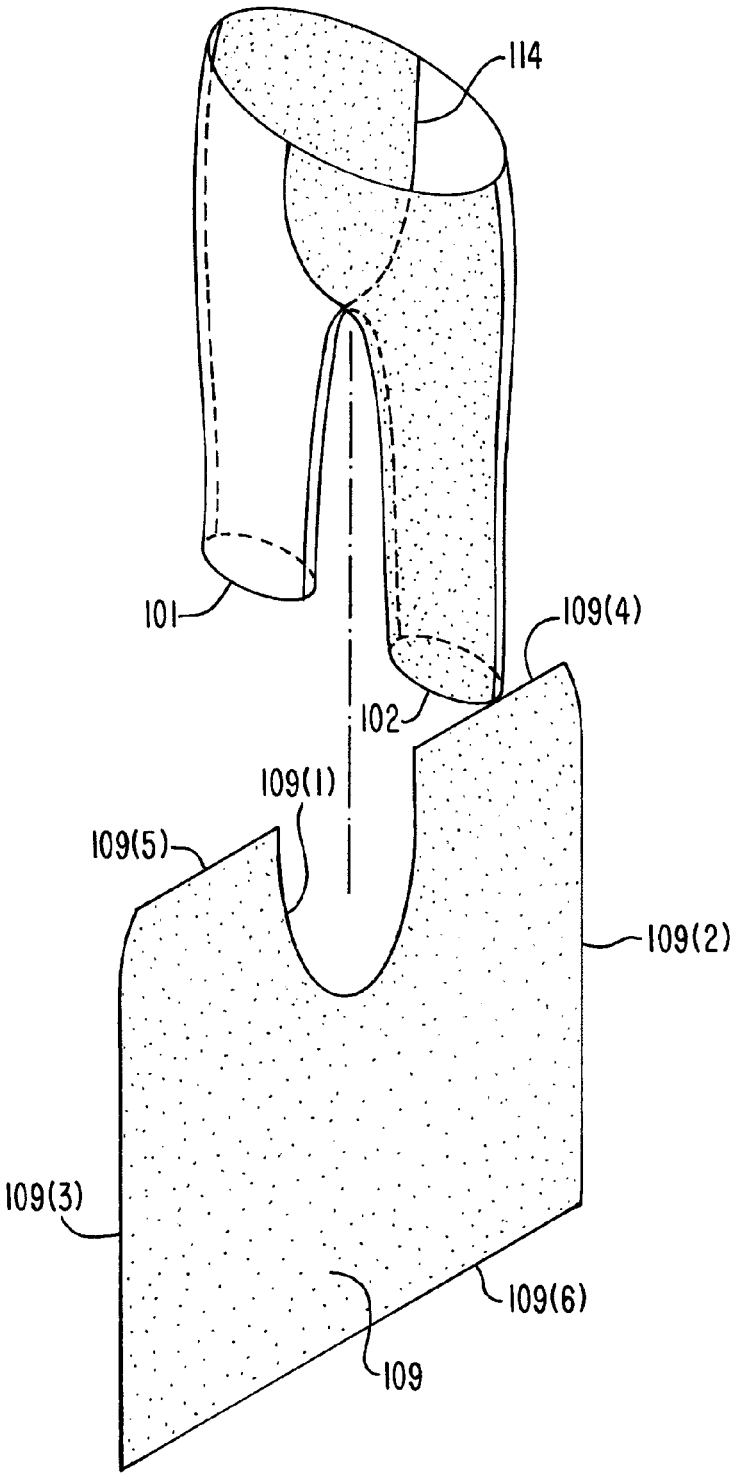

Returning to the embodiment of FIGS. 1A and 1B, and as shown in FIG. 3B, right front panel 106 and right rear panel 105 are joined (by, e.g., stitching) along their respective outseam edges 105(1) and 106(1), as well as along their respective inseam edges 105(2) and 106(2), thereby forming right trouser half 101 having outseam 110 and inseam 111. As shown in FIG. 3C, left front panel 107 and left rear panel 108 are similarly joined along edges 107(1) and 108(1) and along edges 107(2) and 108(2) to form left trouser half 102 having outseam 112 and inseam 113. The crotch edges 105(3) and 106(3) of trouser half 101 are joined to crotch edges 108(3) and 107(3), respectively, of left trouser half 102 to form center seam 114 (FIG. 3D). Finally, edge 109(1) of a U-shaped cut-out formed in reversing panel 109 is attached to right and left trouser halves 101 and 102 along (or near) center seam 114. Side edges 109(2) and 109(3), top edges 109(4) and 109(5), and bottom edge 109(6) are not permanently joined to garment 100, thereby creating front and rear flaps 115 and 116 (FIG. 1A), respectively.

Figure 4A:
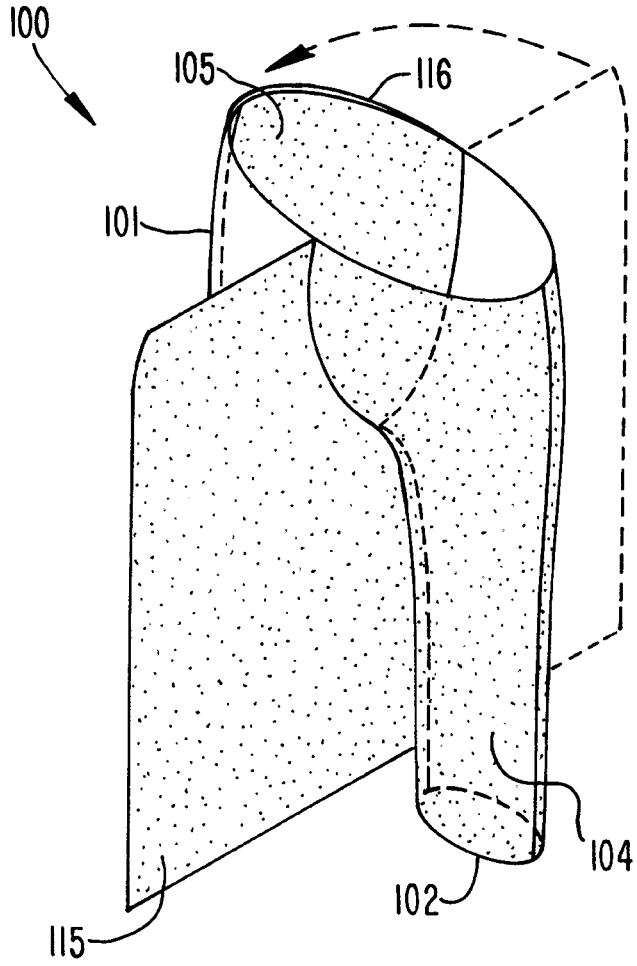
FIGS. 4A and 4B show placement of the garment of FIGS. 1A and 1B into a first configuration.
Figure 4B:
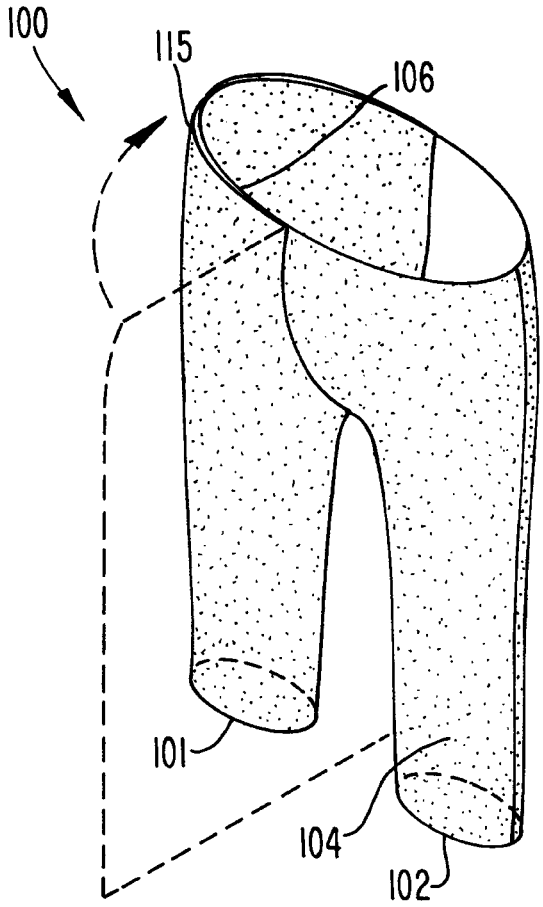
Figure 5A:
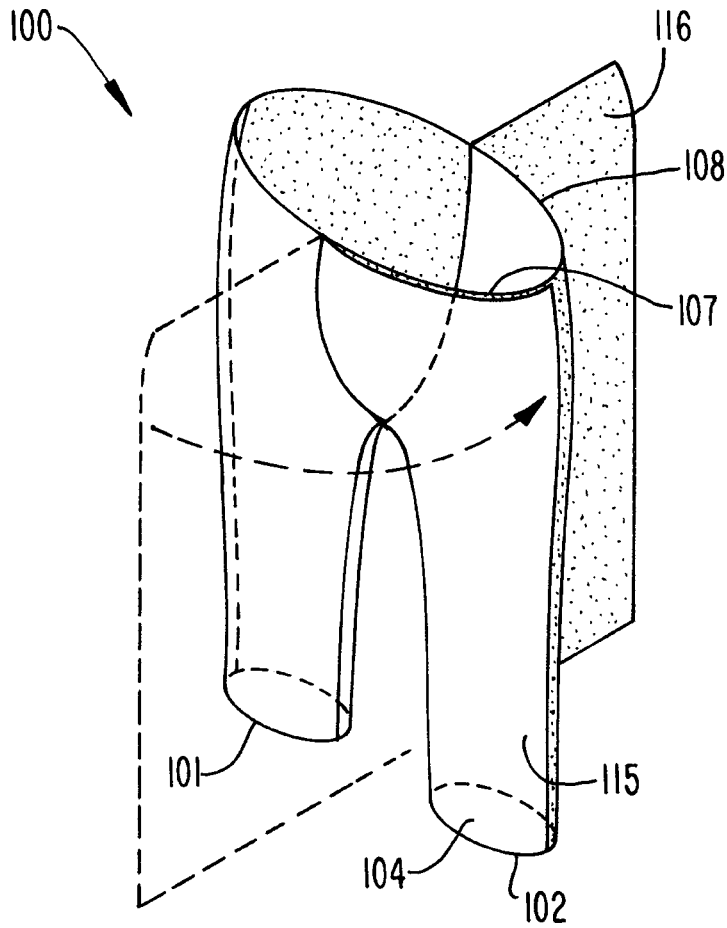
FIGS. 5A and 5B show placement of the garment of FIGS. 1A and 1B into a second configuration.
Figure 5B:
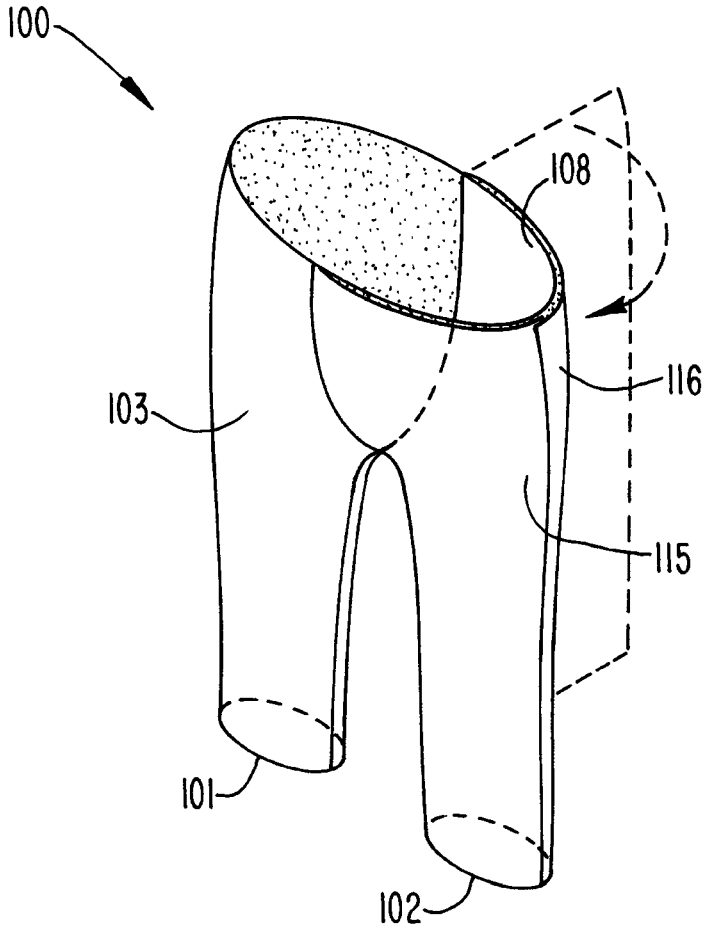

FIGS. 4A through 5B show operation of flaps 115 and 116 so as to place garment 100 into alternate configurations so as to modify the appearance of garment 100. In FIG. 4A, rear flap 116 has just been moved from a center position (shown in broken lines) to a position wrapped around rear panel 105 of right trouser half 101. In this manner, the stippled surface of flap 116 is now the outside surface of the rear portion of right trouser half 101. In FIG. 4B, front flap 115 has just been moved from a center position (shown in broken lines) to a position wrapped around front panel 106 of right trouser half 101 and secured in place (as described in more detail below). In this manner, the stippled surface of flap 115 is now the outside surface of the front portion of right trouser half 101. In this configuration, the garment 100 now appears to have the same surface treatment (stippling) over its entire outer surface, as the exposed surface of reversing panel 109 and the exposed surface 104 of left trouser half 102 have the same surface treatment (stippling). FIGS. 5A and 5B show placement of garment 100 into a configuration showing a second and different type of surface treatment. In FIG. 5A, and front flap 115 has just been moved from a center position (shown with broken lines) to a position wrapped around front panel 107 of left trouser half 102. In this manner, the unstippled surface of flap 115 is now the outside surface of the front portion of left trouser half 102. In FIG. 5B, rear flap 116 has just been moved from a center position (shown in broken lines) to a position wrapped around rear panel 108 of left trouser half 102 and secured in place. In this manner, the unstippled surface of flap 116 is now the outside surface of the rear portion of left trouser half 102. In this configuration, garment 100 now appears to have a different surface treatment (no stippling) over its entire outer surface. The exposed surface of reversing panel 109 and the exposed surface 103 of right trouser half 101 have the same surface treatment (no stippling).

In light of FIGS. 4A-5B, the advantages of garment 100 become readily apparent. A single garment can be worn in either of two configurations, each of which has a different appearance. This offers a significant convenience. For example, a person traveling could pack two separate shirts of different colors, with one shirt matching one of the surface treatments (e.g., stippling) and the other shirt matching the other surface treatment (no stippling). Instead of packing two pairs of pants, only one pair of pants (garment 100) is needed. By having a pair of pants with a double layer of material on one leg and a single layer on the other leg, and by constructing that second layer of material so that it is movable between legs, a versatile garment is obtained.

As indicated above, flaps 115 and 116 are secured in place when wrapped around one of trouser halves 101 or 102. In some embodiments, flaps 115 and 116 are only secured at the waist, either by use of a belt or with fasteners located at the upper portions of edges 109(2) and 109(3) near the waist. In other embodiments, flaps 115 and 116 are secured along the lengths of edges 109(2) and 109(3) when wrapped around one of trouser halves 101 and 102. So as not to confuse the drawings, FIGS. 1A-5B do not show a belt and do not show fasteners on edges 109(2) and 109(3) of reversing panel 109. However, examples of fasteners are shown in FIGS. 6A-7C. Although hook and loop fasteners (e.g., as sold under the trade name VELCRO) and laces are shown as examples, other types of fasteners could be used. Other types of fasteners include buttons, snaps, zippers, etc.

Figure 6A:
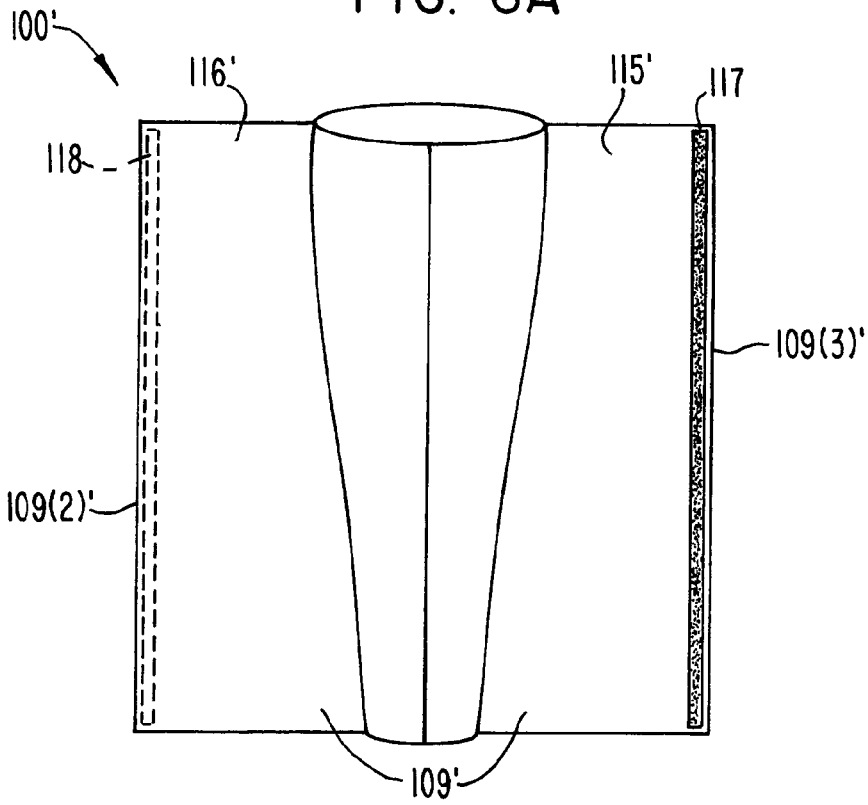
FIGS. 6A-6C show the use of one type of fastener in connection with the garment of FIGS. 1A and 1B.
Figure 6B:
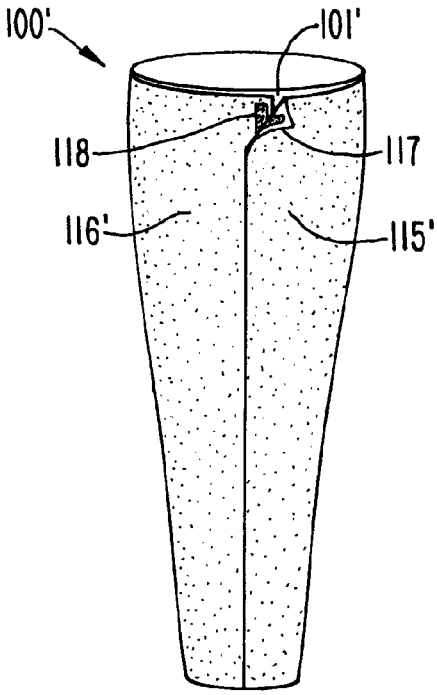
Figure 6C:
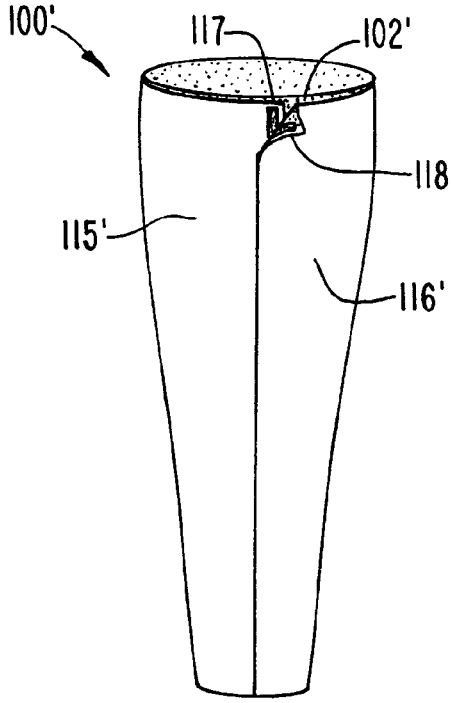

FIG. 6A is a right side view of garment 100', which is similar to garment 100 (FIGS. 1A, 1B and 4A-5B) except for the inclusion of hook and loop fastener material. In particular, a strip of hook fastener material 117 is attached to the right face of front flap 115' near edge 109(3)'. A strip of loop material 118 is attached to the left face of rear flap 116' near edge 109(2)'. FIG. 6B (another right side view) shows flaps 115' and 116' wrapped around right trouser half 101' so as to expose the left face of reversing panel 109'. Hook material 117 mates to loop material 118 at an overlap of flaps 115' and 116', thereby securing flaps 115' and 116' in place. A small corner of front flap 115' is pulled back near the waist to show cooperation of the mating hook and loop strips 117 and 118. FIG. 6C is a left side view and shows flaps 115' and 116' wrapped around left trouser half 102' so as to expose the right face of reversing panel 109'. Hook material 117 again mates to loop material 118 so as to secure flaps 115' and 116' in place. A small corner of rear flap 116' is pulled back near the waist to show cooperation of the mating hook and loop strips 117 and 118.

Figure 7A:
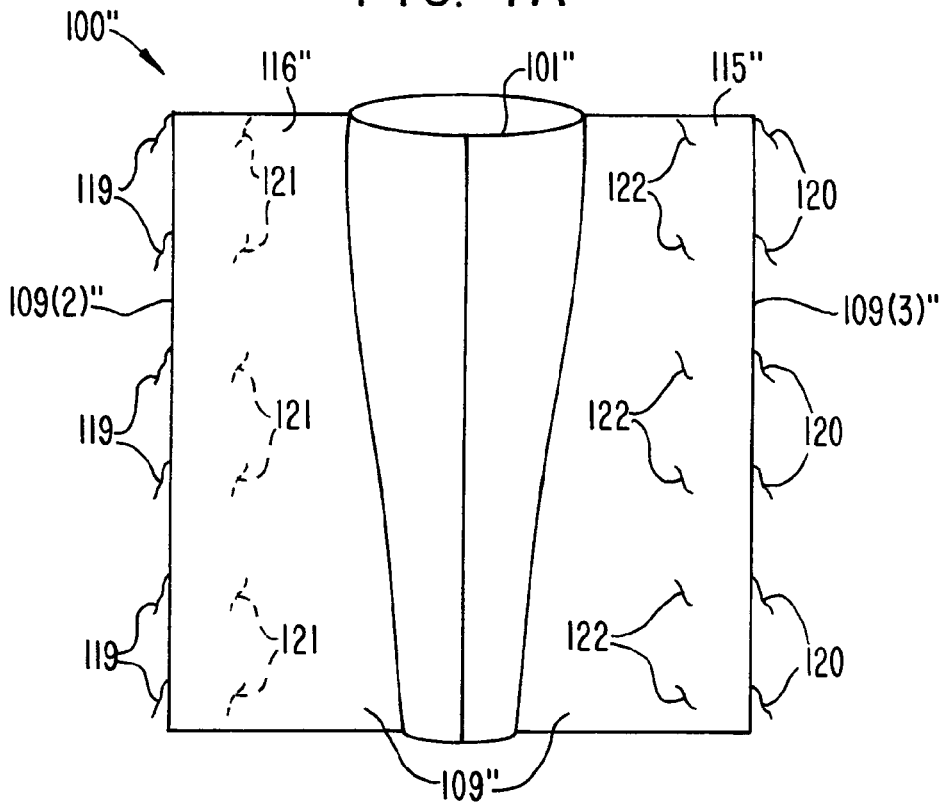
FIGS. 7A-7C show the use of another type of fastener in connection with the garment of FIGS. 1A and 1B.
Figure 7B:
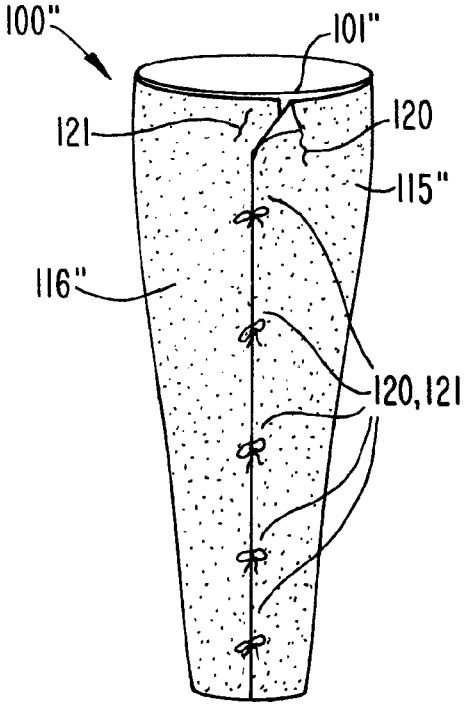
Figure 7C:
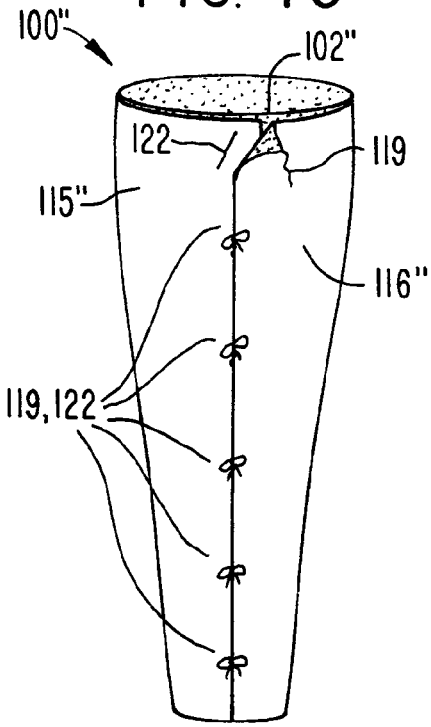

FIG. 7A is a right side view of garment 100", which is similar to garment 100 (FIGS. 1A, 1B and 4A-5B) except for the inclusion of laces on front and rear flaps 115" and 116". In particular, two series of laces 119 and 120 are attached on edges 109(2)" and 109(3)", respectively. Two additional series of laces 121 and 122 are attached offset a short distance away from edges 109(2)" and 109(3)". Laces of series 121 are attached to the left face of rear flap 116", and laces of series 122 are attached to the right face of front flap 115". FIG. 7B (another right side view) shows flaps 115" and 116" wrapped around right trouser half 101" so as to expose the left face of reversing panel 109". Corresponding laces of series 120 and of series 121 are tied together to secure flaps 115" and 116" in place. A small corner of front flap 115" is pulled back near the waist. FIG. 7C is a left side view and shows flaps 115" and 116" wrapped around left trouser half 102" so as to expose the right face of reversing panel 109". Corresponding laces of series 119 and of series 122 are tied together to secure flaps 115" and 116" in place. A small corner of rear flap 116" is pulled back near the waist.

Other types of fasteners could be used in conjunction with, or instead of, hook and pile or laces. As but one example, each of edges 109(2) and 109(3) (e.g., FIG. 3D) could have one half of a zipper attached, with the movable portion of the zipper being accessible when panel 109 is wrapped around either side of garment 100. As but another example, buttons or snaps could be used.

Embodiments such as are shown in FIGS. 1A-7C are not limited by the type of material used. However, possible materials include any type of material in which one face is visibly different from the other face. Examples include two-tone fabrics where one face has one color and the other face has a different color, a printed fabric having a print on one face and a solid color on the other face, and a double weave fabric having different texture and/or structure on opposite faces. Although the embodiments of FIGS. 1A-7C show a garment that includes a pair of full-length pants, this need not be the case. In some embodiments, for example, a convertible garment similar to the embodiment of FIGS. 1A-7C could be designed as a pair of short pants. In still other embodiments, the garment does not cover the wearer's legs. In other words, the garment may include a brief portion covering the wearer's lower abdomen, buttocks and hips, and a smaller reversing flap that only covers that brief. A garment according to the embodiments of FIGS. 1A-7C could also include a fly, pockets, belt loops and/or other conventional features. Notably, the appearance of a garment as shown in FIGS. 1A-7C can be modified without removing the garment from the wearer's body.

Figure 2C:
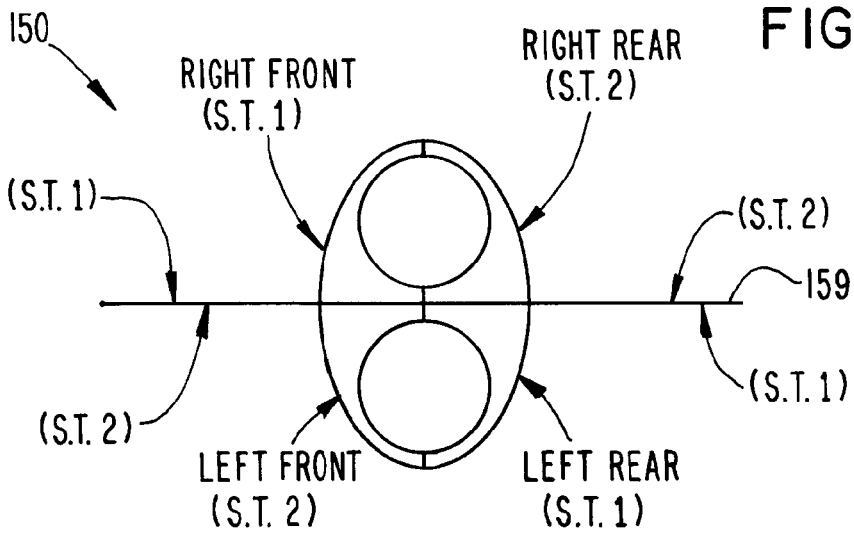
FIGS. 2C-2E are diagrammatic top views of a garment, similar to that of FIGS. 1A and 1B, according to another embodiment of the invention.
Figure 2D:
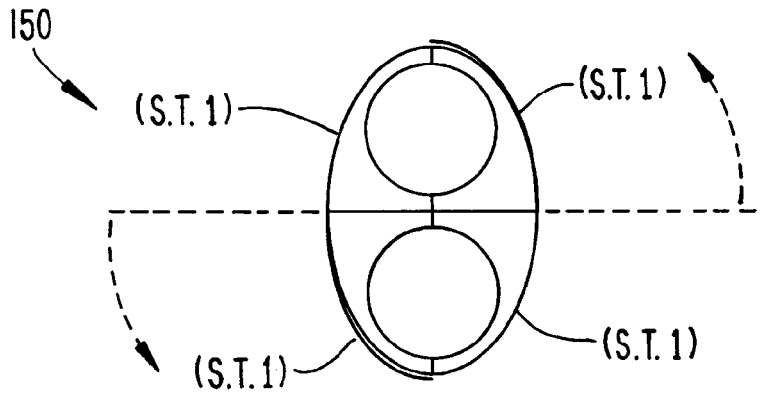
Figure 2E:
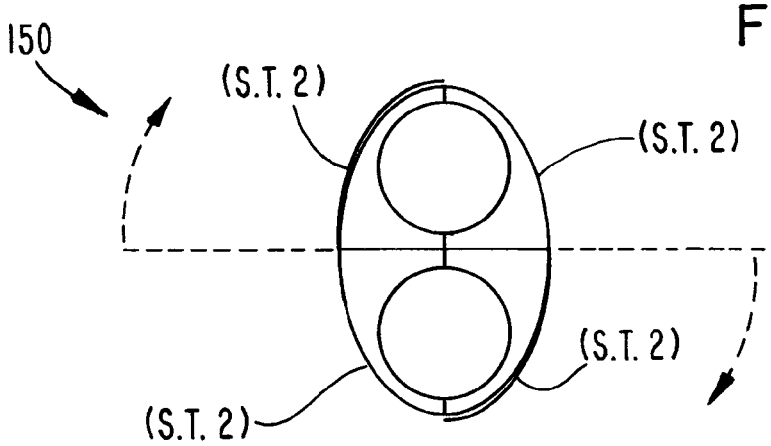

In still other embodiments, and as shown in FIGS. 2C-2E, the appearance of a garment 150 is modified by alternately wrapping the two halves of reversing panel 159 around separate halves of the garment. FIG. 2C is a diagrammatic top view of garment 150 (i.e., looking down into the garment from the above the waist). Garment 150 is constructed similar to garment 100 of FIGS. 1A and 1B. However, the right front and left rear trouser halves of garment 150 have a first surface treatment. The left front and right rear trouser halves of garment 150 have a second (and different) surface treatment. The reversing panel 159 has the first surface treatment on its right front and left rear faces, and the second surface treatment on its left front and right rear faces. In FIG. 2D, the front flap of reversing panel 159 has been wrapped around the left front trouser half and the rear flap of reversing panel 159 has been wrapped around the right rear trouser half. The flaps are then secured in place with fasteners such as hook and pile, etc. (not shown). In this configuration, garment 150 has the first surface treatment on all exposed surfaces. In FIG. 2E, the front flap of reversing panel 159 has been wrapped around the right front trouser half and the rear flap of reversing panel 159 has been wrapped around the left rear trouser half. The flaps are then secured in place with fasteners (not shown). In this configuration, garment 150 has the second surface treatment on all exposed surfaces.

In still other embodiments, and similar to the embodiment of FIGS. 2A and 2B, one side of a pair of trousers can be made from one type of fabric having a first treatment (no stippling) on both faces, and the other side of the trousers formed from a second fabric having a second surface treatment (stippling) on both faces. However, instead of a single reversing panel having the first surface treatment (no stippling) on one face and the second surface treatment (stippling) on the other face (such as panel 149 shown in FIGS. 2A and 2B), two panels are provided. A first reversing panel would have the first treatment (no stippling) on both faces, would be the same shape as reversing panel 149, and would be located on the first surface treatment (no stippling) side of the trouser crotch. A second reversing panel would have the second treatment (stippling) on both faces, would be the same shape as reversing panel 149, and would be located on the second surface treatment (stippling) side of the trouser crotch. In order for the trousers to have a single outer surface treatment, both panels would be wrapped around one side of the trousers. In order for the trousers to have one surface treatment on one side of the trousers and the other surface treatment on the other side, one panel would be wrapped around one side of the trousers and the other panel would be wrapped around the other side of the trousers.

As previously indicated, garments such as the embodiments shown in FIGS. 1A-7C offer substantial versatility and convenience. In particular, a single garment can be easily and quickly be converted to a different configuration. The allows a single garment to be used in a variety of situations which would otherwise require separate garments.

Figure 8A:
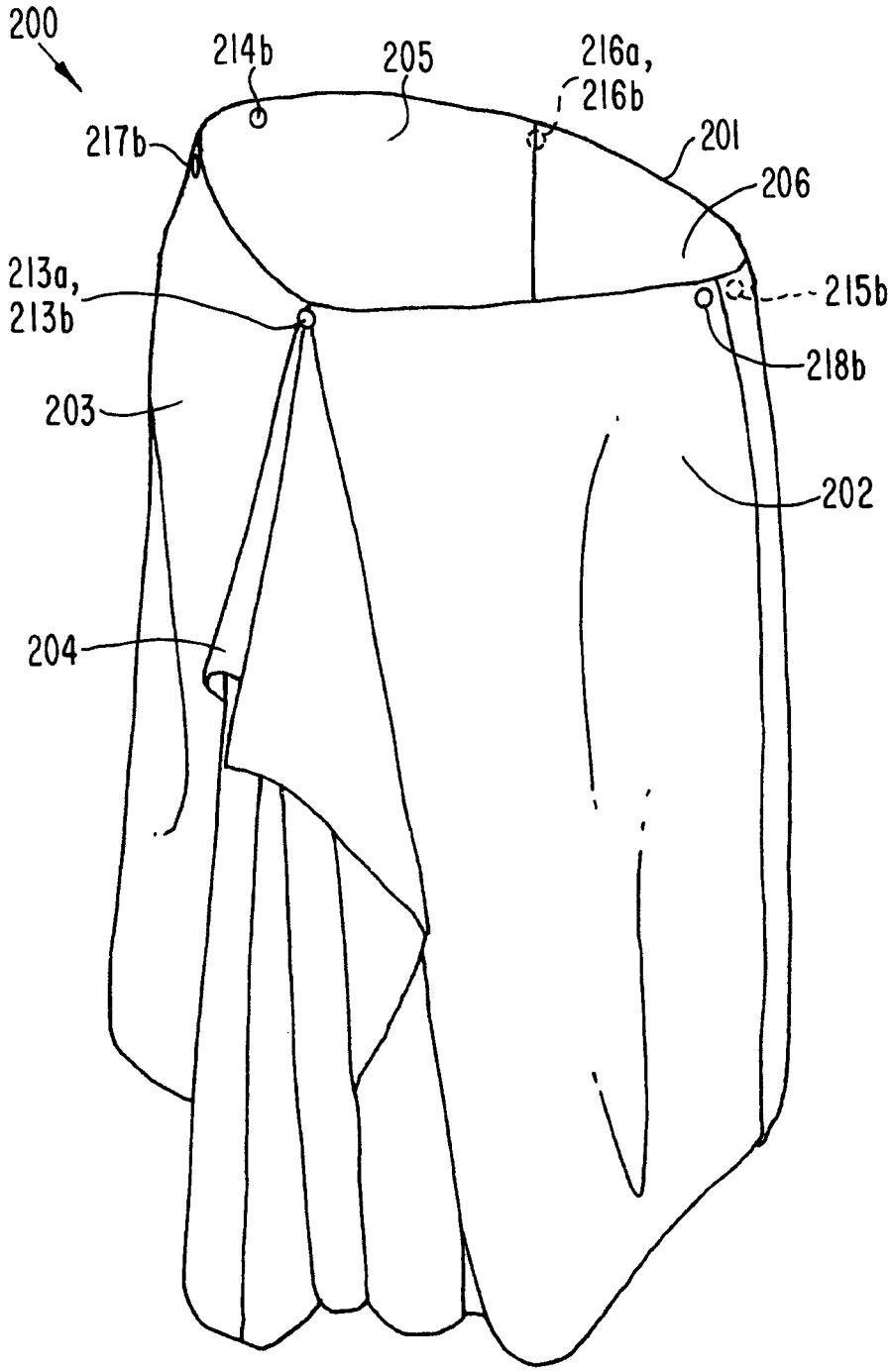
FIGS. 8A and 8B are perspective views of garment according to other embodiments of the invention configured for wear as a skirt.
Figure 8B:
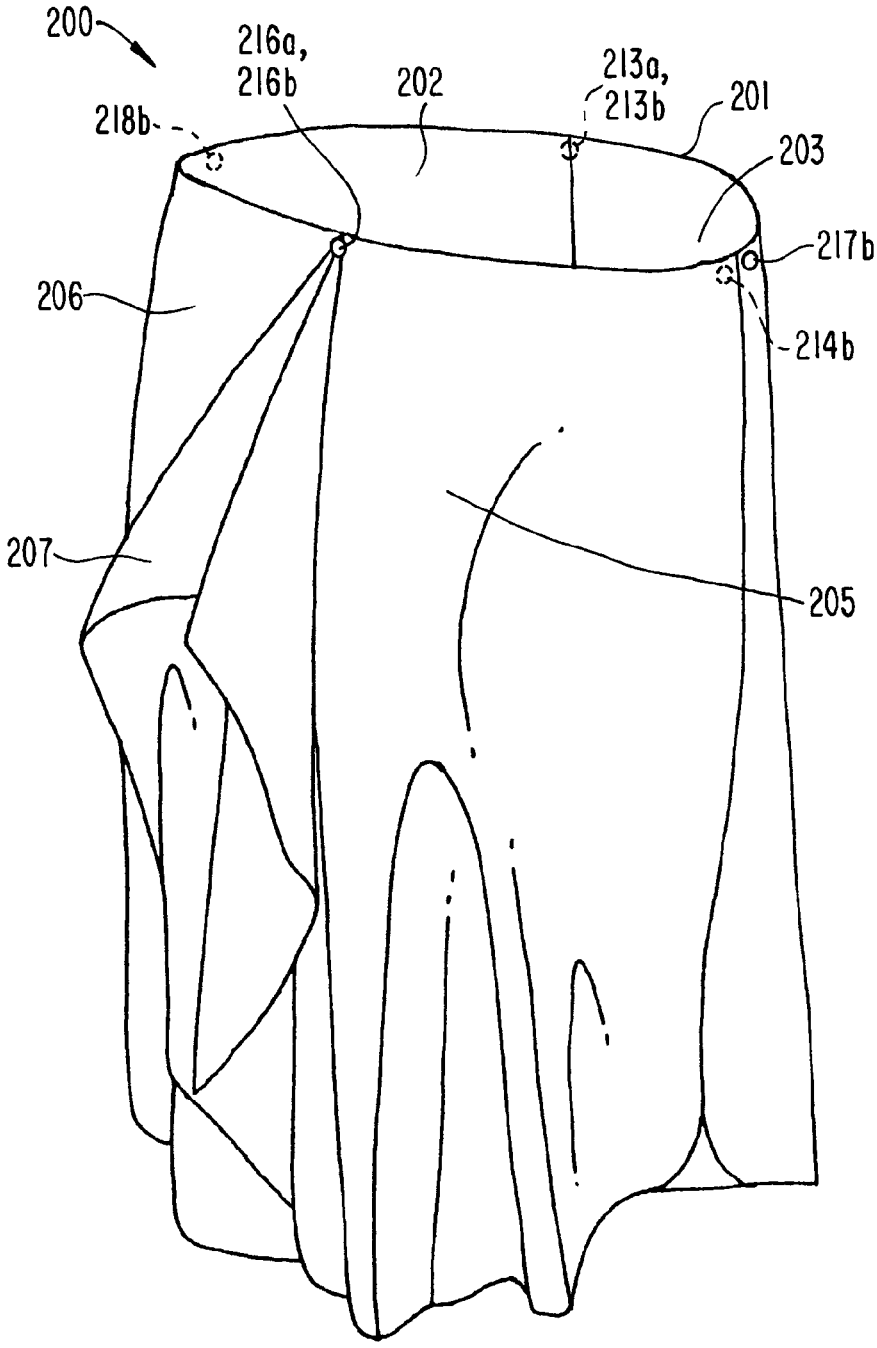
Figure 8C:
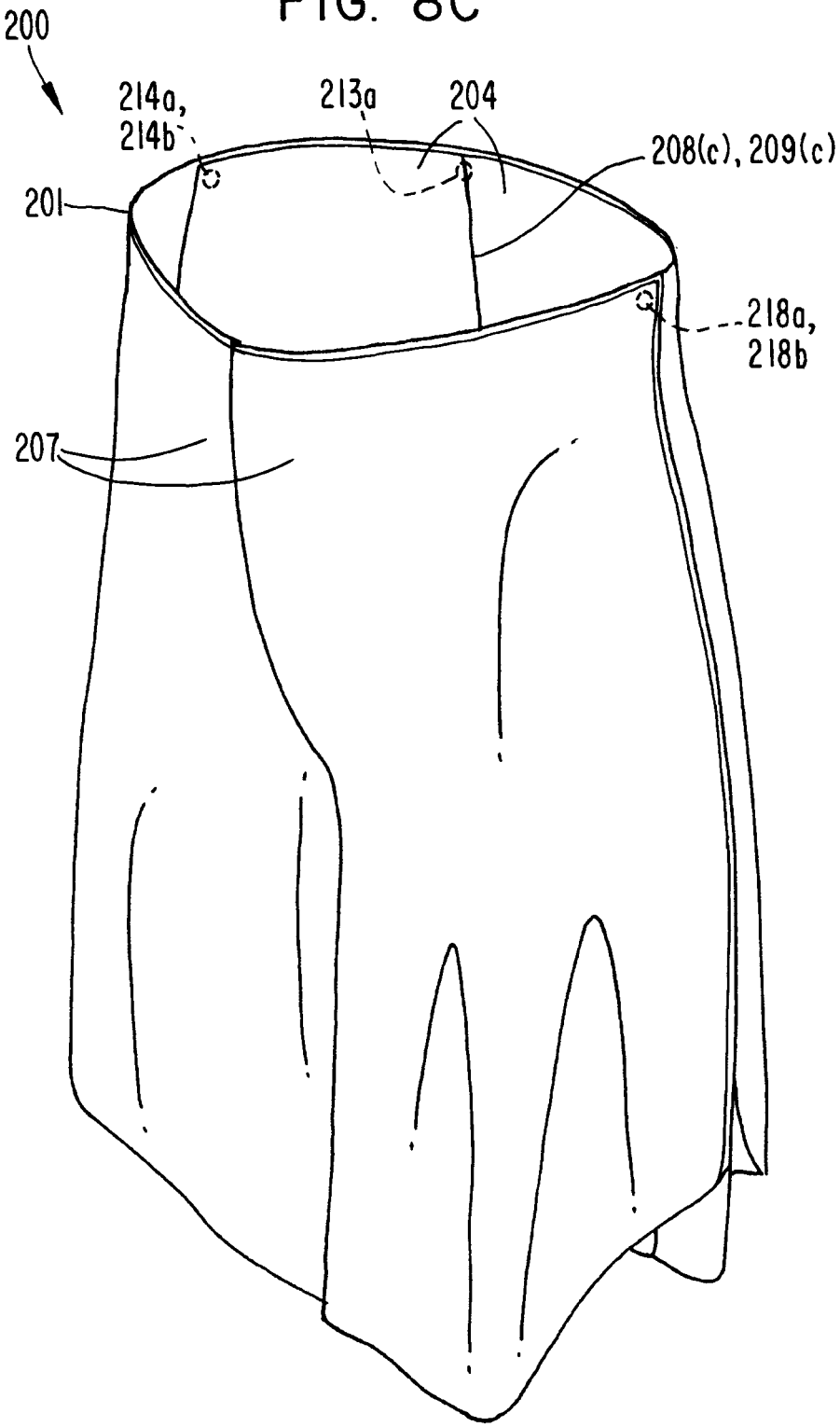
FIGS. 8C and 8D are perspective views of the garment of FIGS. 8A and 8B configured for wear as short pants.
Figure 8D:
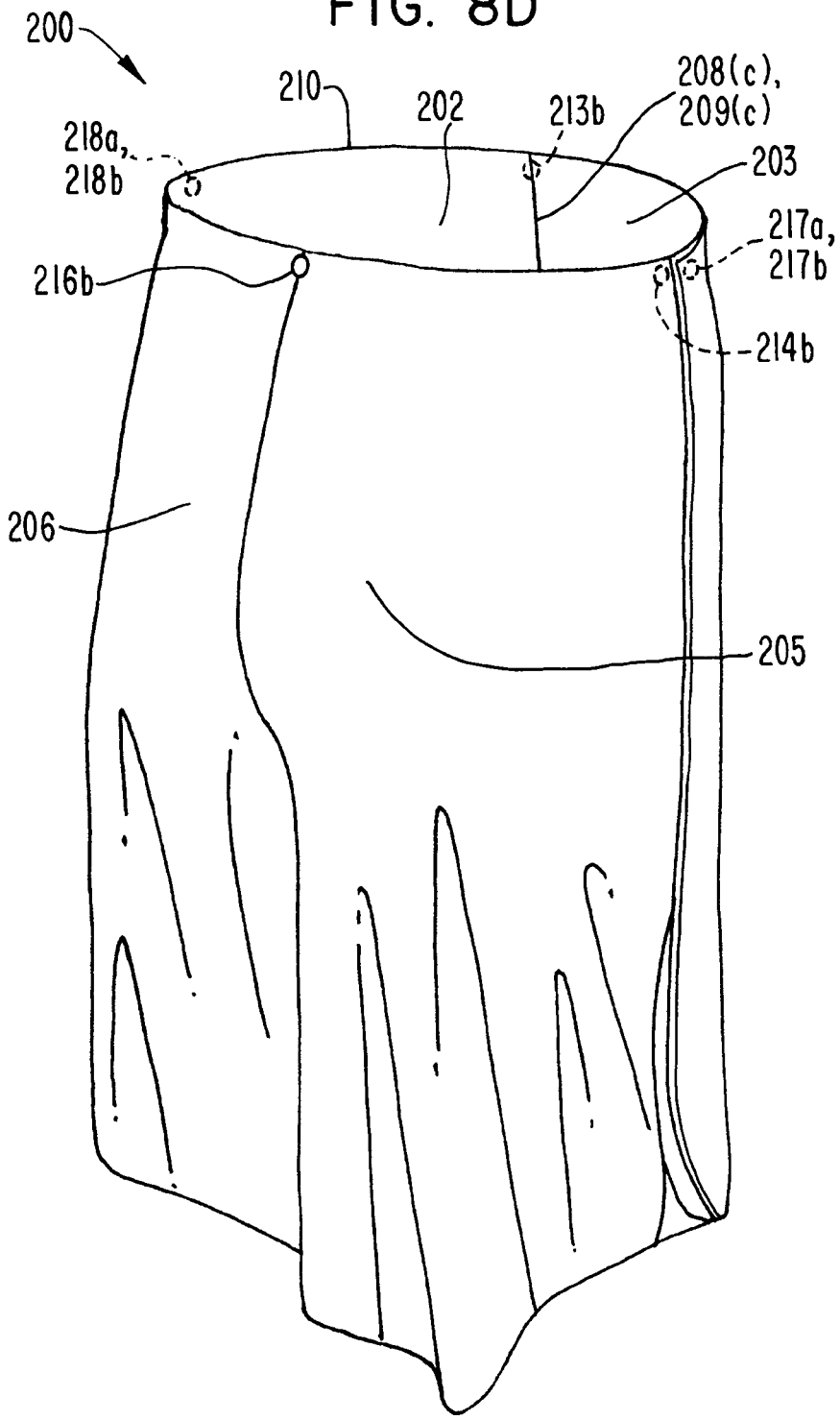

FIGS. 8A-8D show a garment 200 according to additional embodiments, and which also offers substantial versatility and convenience. In particular, garment 200 can be placed in a first configuration and worn as a skirt. Garment 200 can also be placed into a second configuration and worn as a pair of shorts. FIG. 8A is a left front perspective view of garment 200 in a skirt configuration. Garment 200 has a waist edge 201, a left front section 202 and a right front section 203. Attached with snaps 213*a* and 213*b* to the outside front near waist edge 201 is a front conversion tail 204. FIG. 8B is a right rear perspective view of garment 200 in a skirt configuration, and shows right rear section 205, left rear section 206 and rear conversion tail 207. Rear conversion tail 207 is attached to the outside rear near waist edge 201 with snaps 216*a* and 216*b*. FIG. 8C is a left front perspective view of garment 200 configured for wear as short pants. In this configuration, front conversion tail 204 is snapped to the rear inside of garment 200, and rear conversion tail 207 is snapped to the outside front garment of 200. FIG. 8D is a right rear perspective view of garment 200 in the shorts configuration. As shown in FIGS. 8A-8D, the upper parts of left front section 202 and right front section 203 form a portion of garment 200 covering the lower abdomen of a wearer. The upper parts of right rear section 205 and left rear section 206 form a portion of garment 200 covering the buttocks of the wearer.

Figure 9:
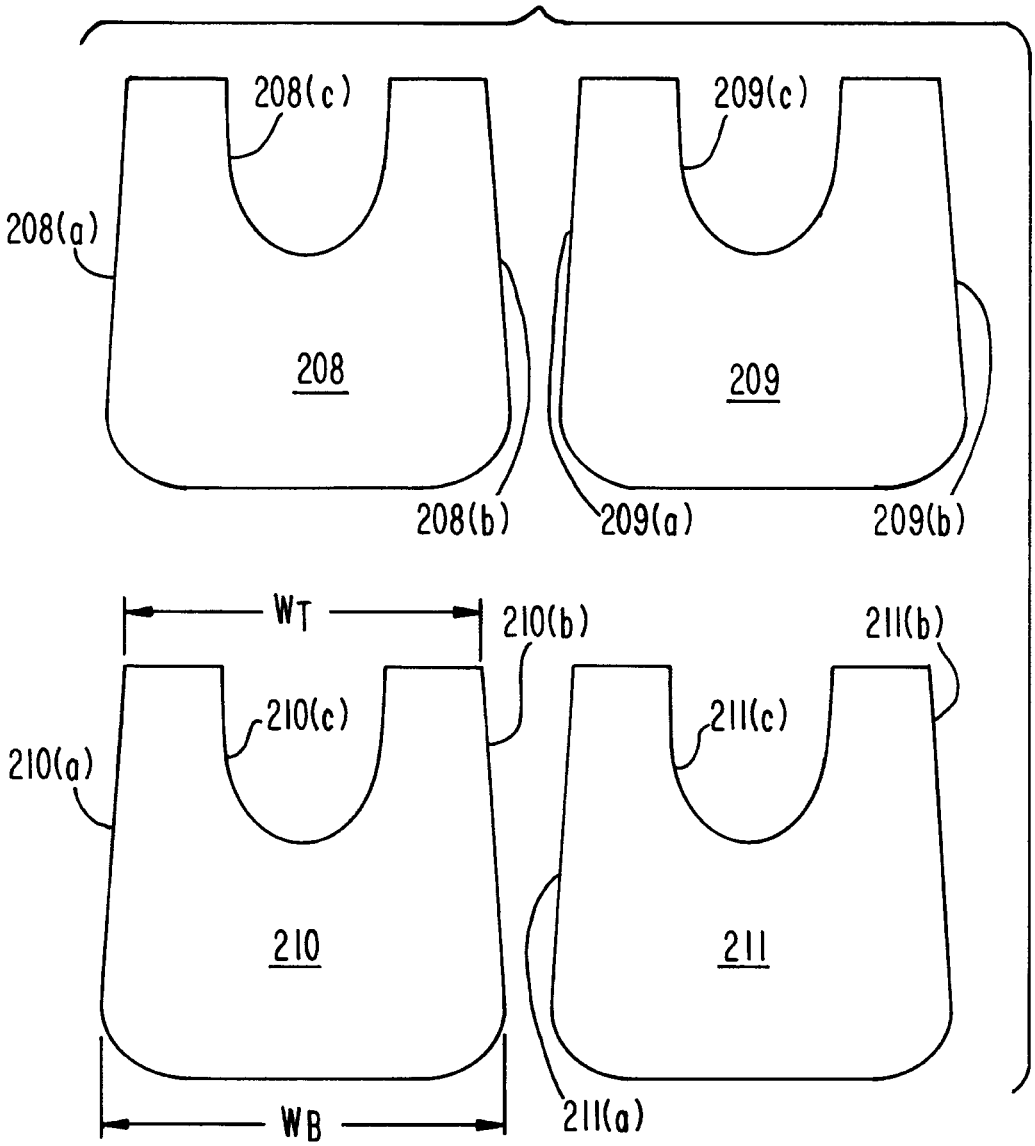
FIG. 9 is a pattern for the garment of FIGS. 8A-8D.
Figure 10:
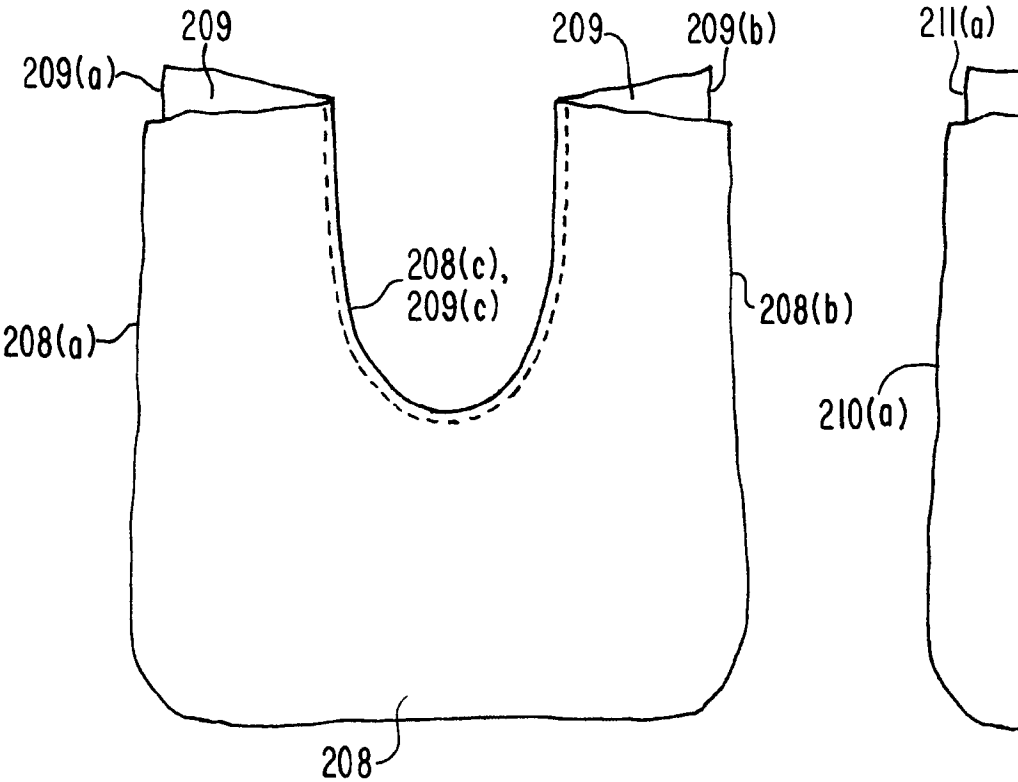
FIGS. 10-13 show construction of the garment of FIGS. 8A-8D using panels from the pattern of FIG. 9.
Figure 11:
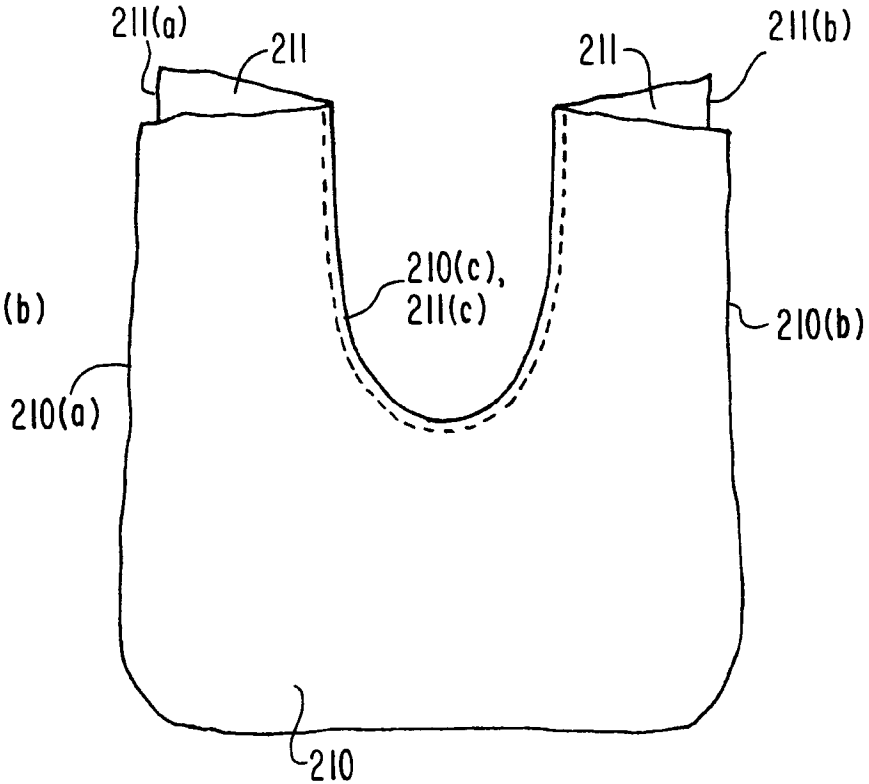

So as to more easily explain the manner in which garment 200 may alternately be configured as a skirt or as short pants, the construction of garment 200 is first described. Shown in FIG. 9 is a pattern for garment 200 according to at least some embodiments. Garment 200 is formed from four substantially identical panels 208-211. Each of panels 208-211 is generally trapezoidal in shape, having bottom a width $w_B$ that is somewhat wider than a top width $w_T$, as well as rounded bottom corners. Formed in the top edge of each of panels 208-211 are "U" shaped crotch cutouts 208(*c*), 209(*c*), 210(*c*) and 211(*c*). Also identified in FIG. 9 are side edges 208(*a*), 208(*b*), 209(*a*), 209(*b*), 210(*a*), 210(*b*), 211(*a*) and 211(*b*) of panels 208-211. The significance of these side edges will be apparent below. Panels 208 and 209, which will form left front section 202, right front section 203 and front conversion tail 204, are joined by sewing together the edges of crotch cutouts 208(*c*) and 209(*c*) (FIG. 10). Panels 210 and 211, which will form left rear section 206, right rear section 205 and rear conversion tail 207, are similarly joined by sewing together the edges of their respective crotch cut-outs 210(*c*) and 211(*c*) (FIG. 11).

Figure 12:
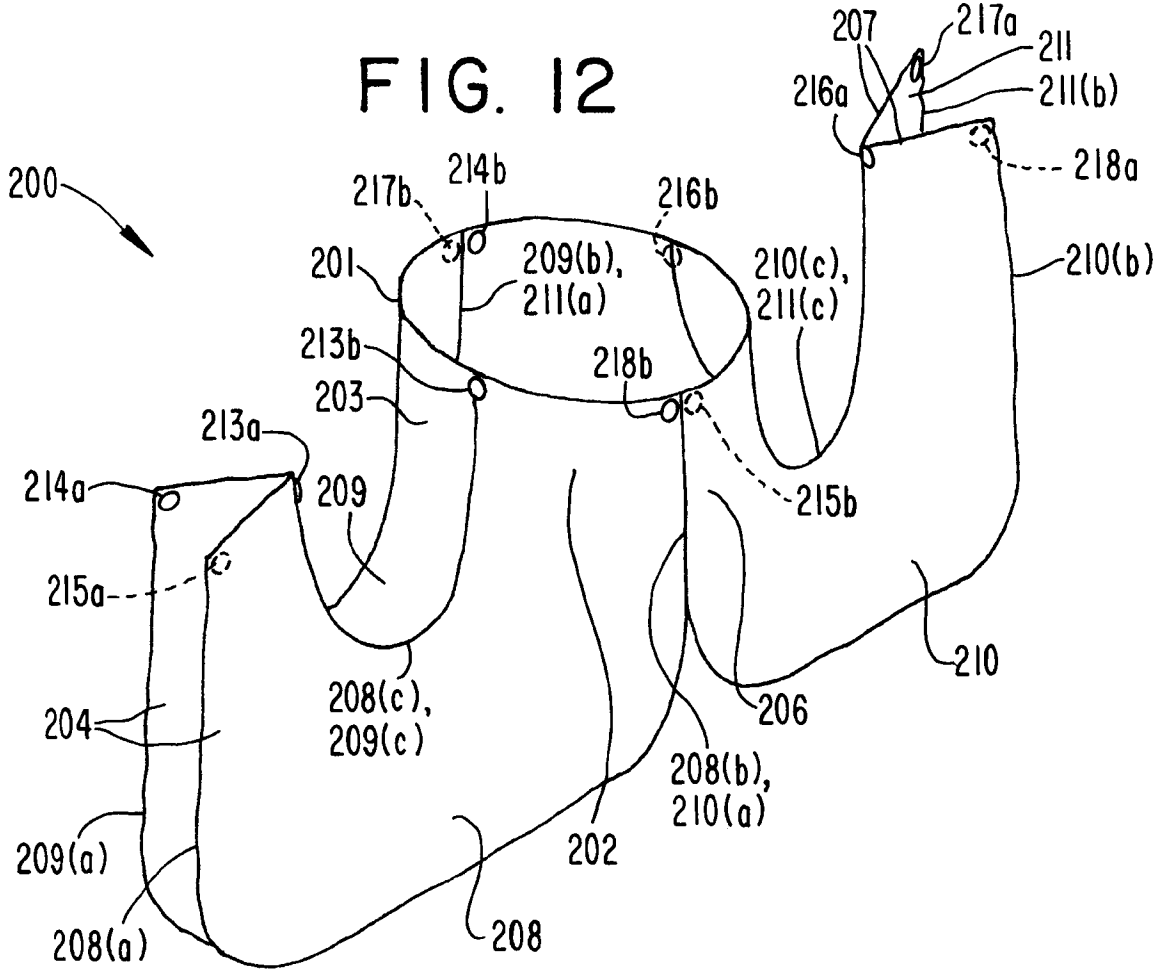
Figure 13:
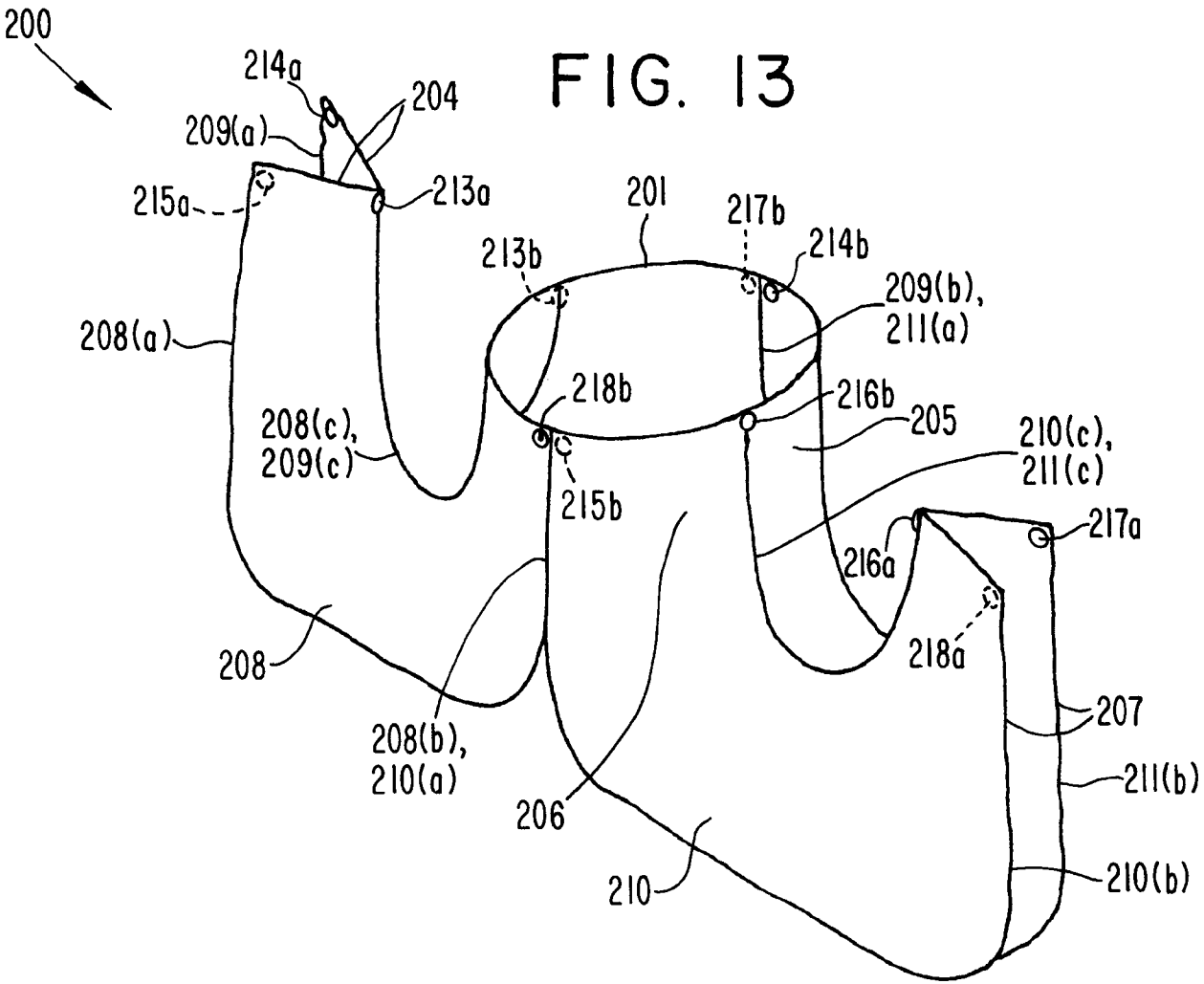

Next, and as shown in FIG. 12, side edge 208(*b*) of panel 208 is sewn to side edge 210(*a*) of panel 210, and side edge 209(*b*) of panel 209 is sewn to side edge 211(*a*) of panel 211. As shown in FIG. 12, a portion of panel 208 forms left front section 202, and a portion of panel 209 forms right front section 203. Another portion of panel 208, together with another portion of panel 209, forms front conversion tail 204. Portions of the top edges of each of panels 208-211 form a continuous, uninterrupted waist edge 201. In some embodiments, waist edge 201 may be reinforced by folding over a small section of material around the circumference of waist edge 201. FIG. 13 is a perspective view of garment 200 from the rear, and shows rear conversion tail 207 (formed from portions of panels 210 and 211), left rear section 206 (formed from another portion of panel 210) and right rear section 205 (formed from another portion of panel 211).

Snaps (or other appropriate fasteners) are also added. In the embodiments of FIGS. 8A-15B, snap fasteners are used. In FIGS. 8A-15B, snaps are shown as either solid line circles or broken line circles. A solid line circle indicates that a snap fastener is on the side of a fabric portion visible in a particular view; a broken line circle indicates that a fastener is on the side of a fabric portion not visible in a particular view. In FIG. 8A, for example, snap 214*b* is on the inside of garment 200 near waist edge 201 and visible; snaps 216*a* and 216*b* are on the outside rear of garment 200, and thus not visible in FIG. 8A. For convenience, mating snaps are given the same reference number but are differentiated by "a" or "b." Returning to FIG. 13, snap 213*a* is added to front conversion tail 204 at the corners of the joined crotch cut-outs 208(*c*) and 209(*c*). Mating snap 213*b* is then placed at the front outside center near waist edge 201. Snaps 214*a* and 215*a* are then added to the outer corners of front conversion panel 204. Mating snaps 214*b* and 215*b* are then placed on the inside right rear and inside left rear of garment 200 near waist edge 201 (see FIG. 8A). Snap 216*a* is added to rear conversion panel 207 at the corners of the joined crotch cut-out on the upper side. Mating snap 216*b* is then placed at the rear outside center of garment 200 near waist edge 201. Snaps 217*a* and 218*a* are then added to the outer corners of rear conversion panel 207. Mating snaps 217*b* and 218*b* are then placed on the outside right front and outside left front of garment 200 near waist edge 201 (see FIG. 12).

Figure 14A:
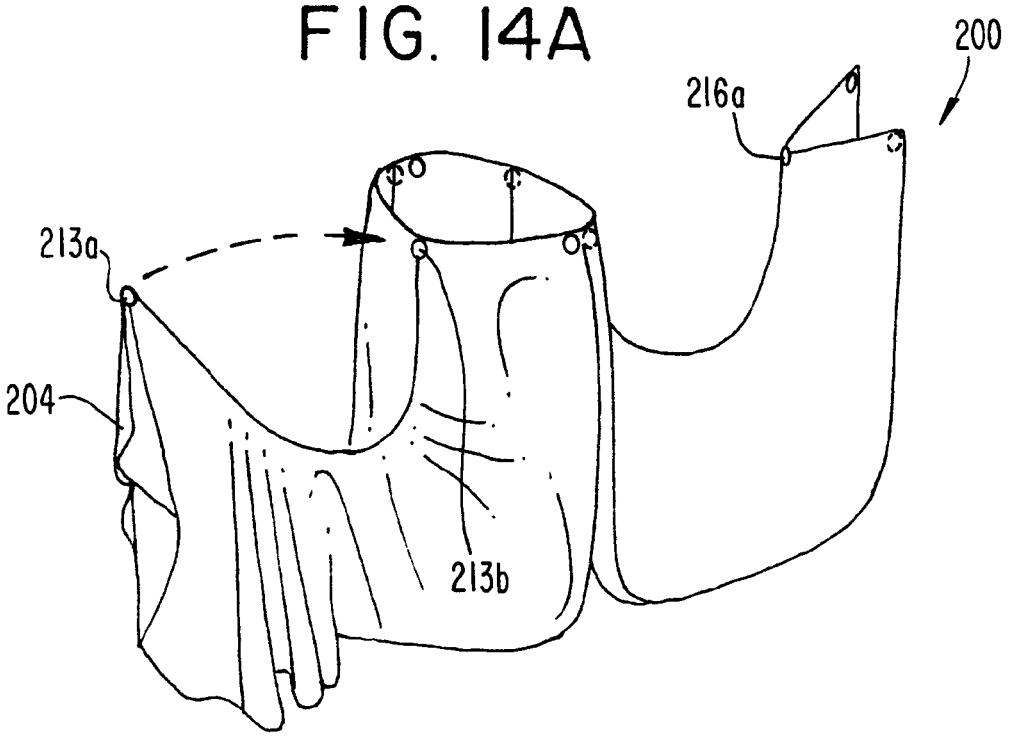
FIGS. 14A-14D show placement of the garment of FIGS. 8A-8D, 12 and 13 into configuration for wear as a skirt.
Figure 14B:
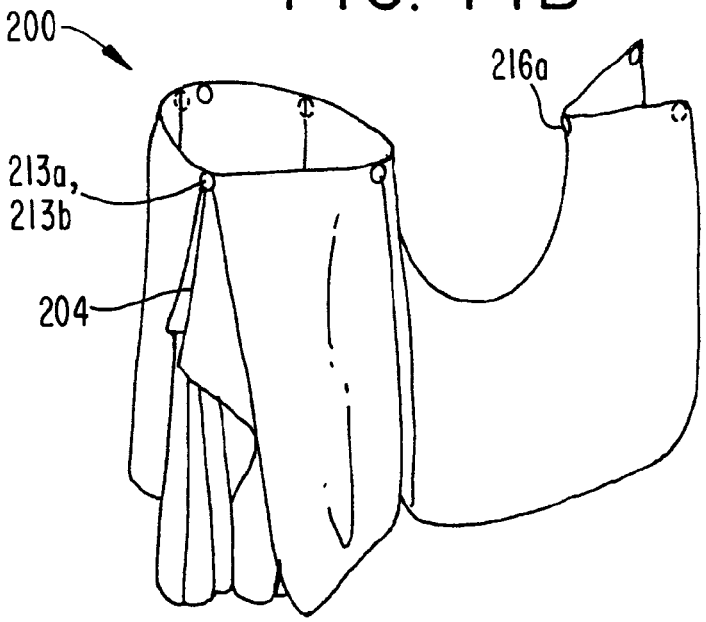
Figure 14C:
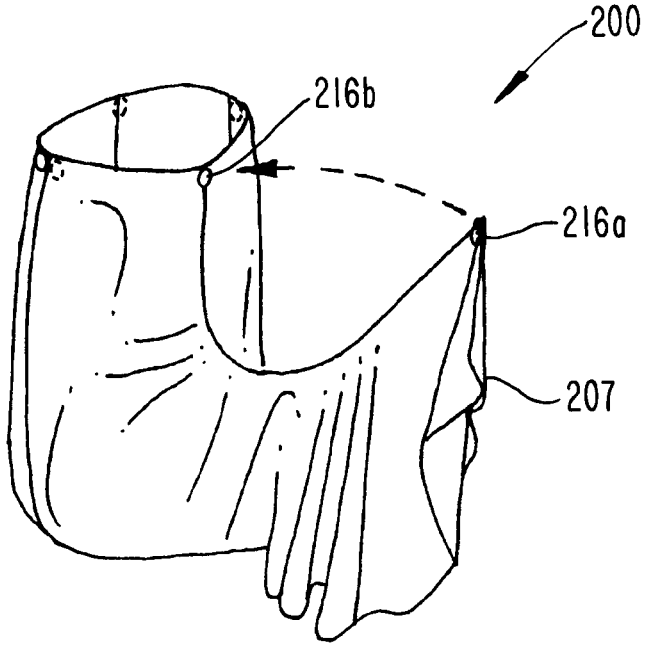
Figure 14D:
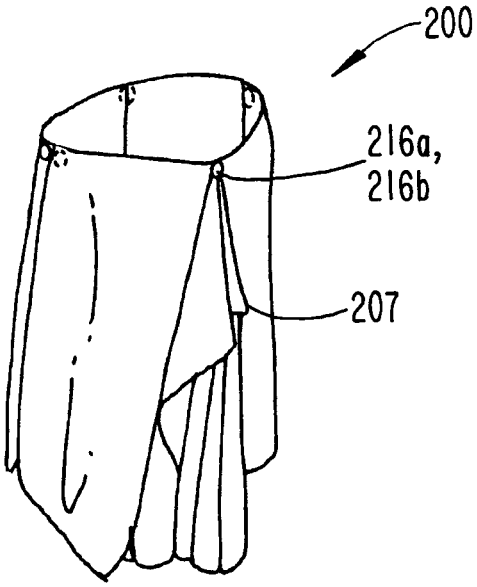

FIGS. 14A-14D show placement of garment 200 into a skirt configuration. As shown in FIG. 14A, snap 213*a* of front conversion panel 204 is attached to mating snap 213*b*. In this manner, and as shown in FIG. 14B, front conversion tail 204 is attached to the front of garment 200 and permitted to hang loosely. As shown in FIG. 14C, snap 216*a* of rear conversion panel 207 is attached to mating snap 216*b*. In this manner, and as shown in FIG. 14D, rear conversion tail 207 is attached to the rear of garment 200 and also permitted to hang loosely.

Figure 15A:
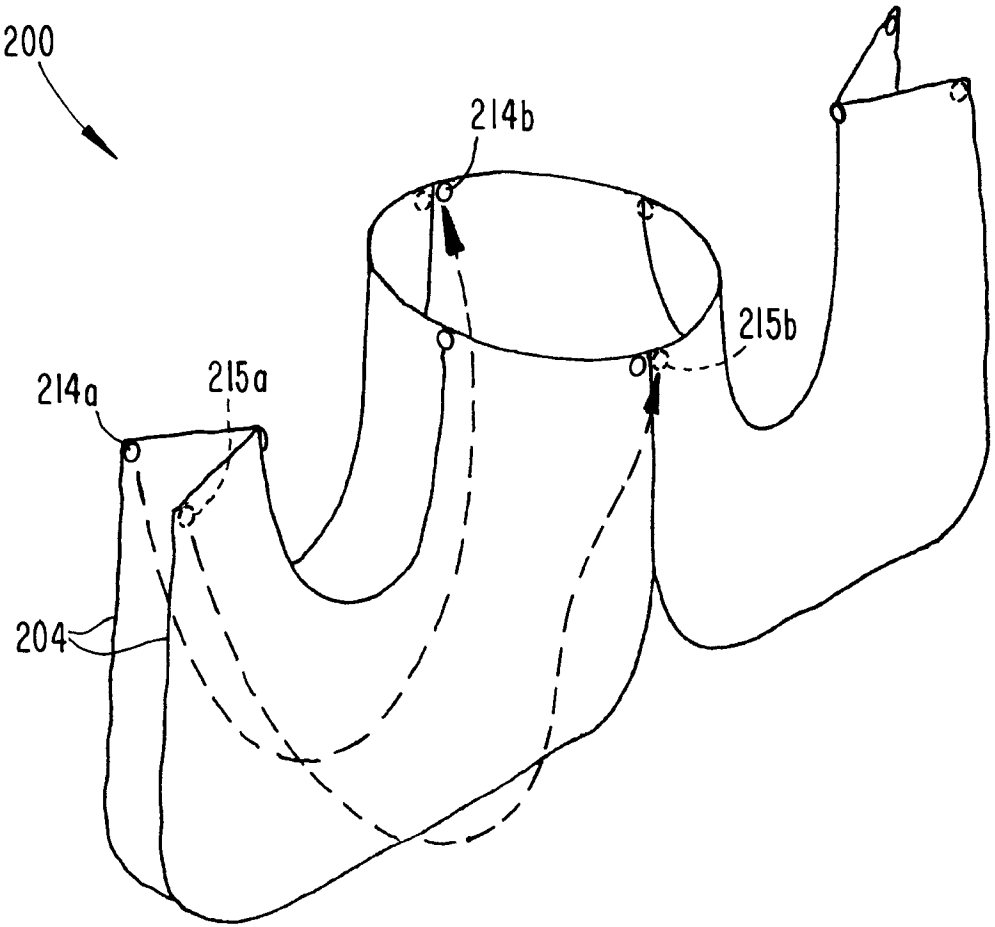
FIGS. 15A and 15B show placement of the garment of FIGS. 8A-8D, 12 and 13 into configuration for wear as short pants.
Figure 15B:
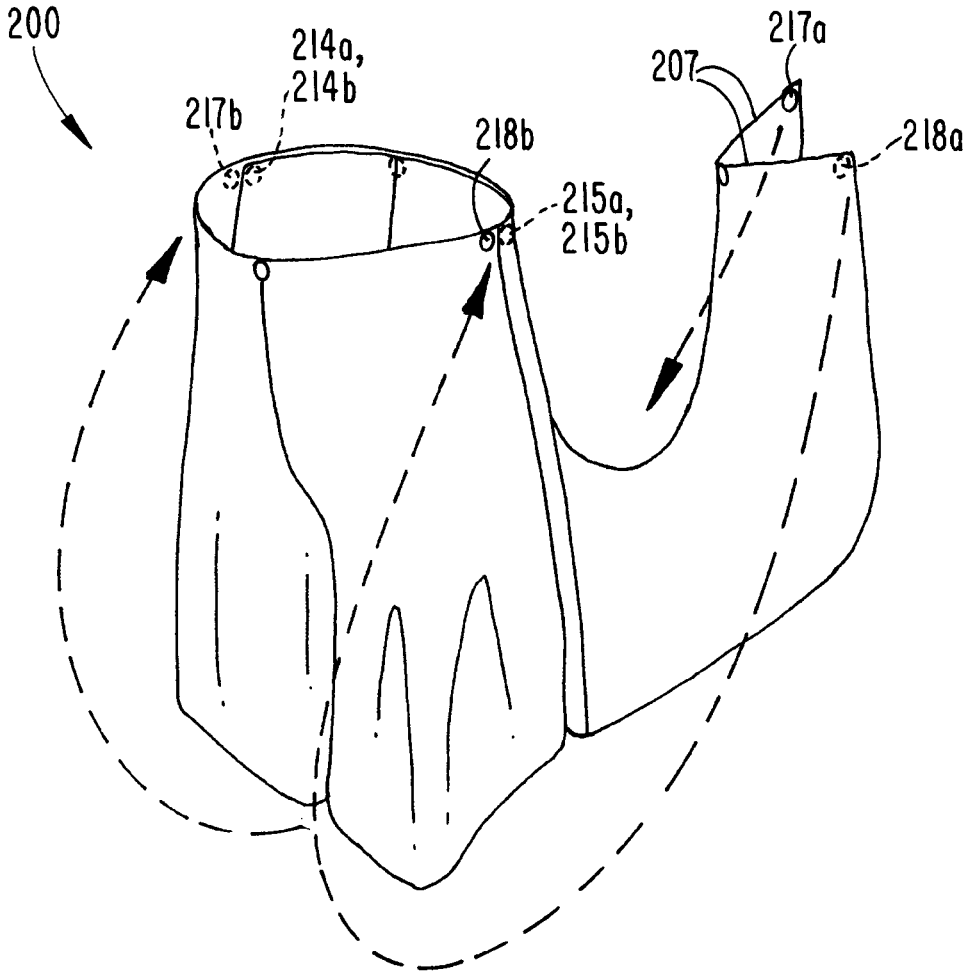

FIGS. 15A and 15B show placement of garment 200 into a short pants configuration. Beginning in FIG. 15A, front conversion panel 204 is moved downward and to the rear. The two sides of front conversion panel 204 are spread apart, and snaps 214*a* and 215*a* are attached to mating snaps 214*b* and 215*b* on the inside rear near waist edge 201 (FIG. 15B). The seam formed by sewing together the crotch cut-outs 208(*c*) and 209(*c*) of panels 208 and 209 has now become the inside crotch of garment 200. Next, and as shown in FIG. 15B, rear conversion panel 207 is flattened and wrapped around the outside of the crotch formed by the front conversion panel 204. The seam formed by sewing together edges 210(*c*) and 211(*c*) has now become the outside crotch of garment 200. Snaps 217*a* and 218*a* are attached to mating snaps 217*b* and 218*b* on the outside front of garment 200 (see FIG. 8C). In other embodiments (not shown), an additional snap is provided on the inside rear near waist edge 201 and between snaps 214*b* and 215*b* (i.e., on the opposite side of snap 216*b*), with a mating snap attached to front conversion panel 204 between snaps 214*a* and 215*a* (i.e., on the opposite side of snap 213*a*). In such embodiments, an additional snap is also provided on rear conversion panel 207 between snaps 217*a* and 218*a* (i.e., on the opposite side of snap 216*a*), and is mated to snap 213*b* in the short pants configuration. Two additional snaps could also be added between snaps 214*a* and 215*a* in the centers of the panel portions forming the upper edge of tail 204 (i.e., a total of five snaps evenly spaced across the outside upper edge of tail 204) and two mating snaps added to corresponding locations the inside rear near waist edge 201. Two more snaps could then be added between snaps 217*a* and 218*a* in the centers of the panel portions forming the upper edge of tail 207 (i.e., a total of five snaps evenly spaced across the outside upper edge of tail 207) and two mating snaps added to corresponding locations the outside front near waist edge 201. In this embodiment, there would be twenty-four snaps in all.

As with the embodiment of FIGS. 1A-7C, the embodiments of FIGS. 8A-15E are similarly not limited by type of material used. However, possible materials include lightweight fabrics woven or knitted from either natural or synthetic fibers. Similarly, fasteners other then snaps could be used (e.g., buttons, hook and loop fasteners, hooks, etc.). In alternate embodiments, panels used to form a garment similar to garment 200 are not trapezoidal in shape and/or may not have rounded corners.

Embodiments such as in FIGS. 8A-15E also offer many advantages similar to those offered by the embodiments of FIGS. 1A-7C. In particular, garment 200 allows a person to have a single garment usable under a variety of circumstances that would ordinarily require two garments. For example, garment 200 could be worn in the shorts configuration for activities such as hiking, tennis, etc. Garment 200 could then be placed into the skirt configuration and worn when a less casual garment might be needed (e.g., going to a restaurant after hiking or playing tennis).

Figure 16A:
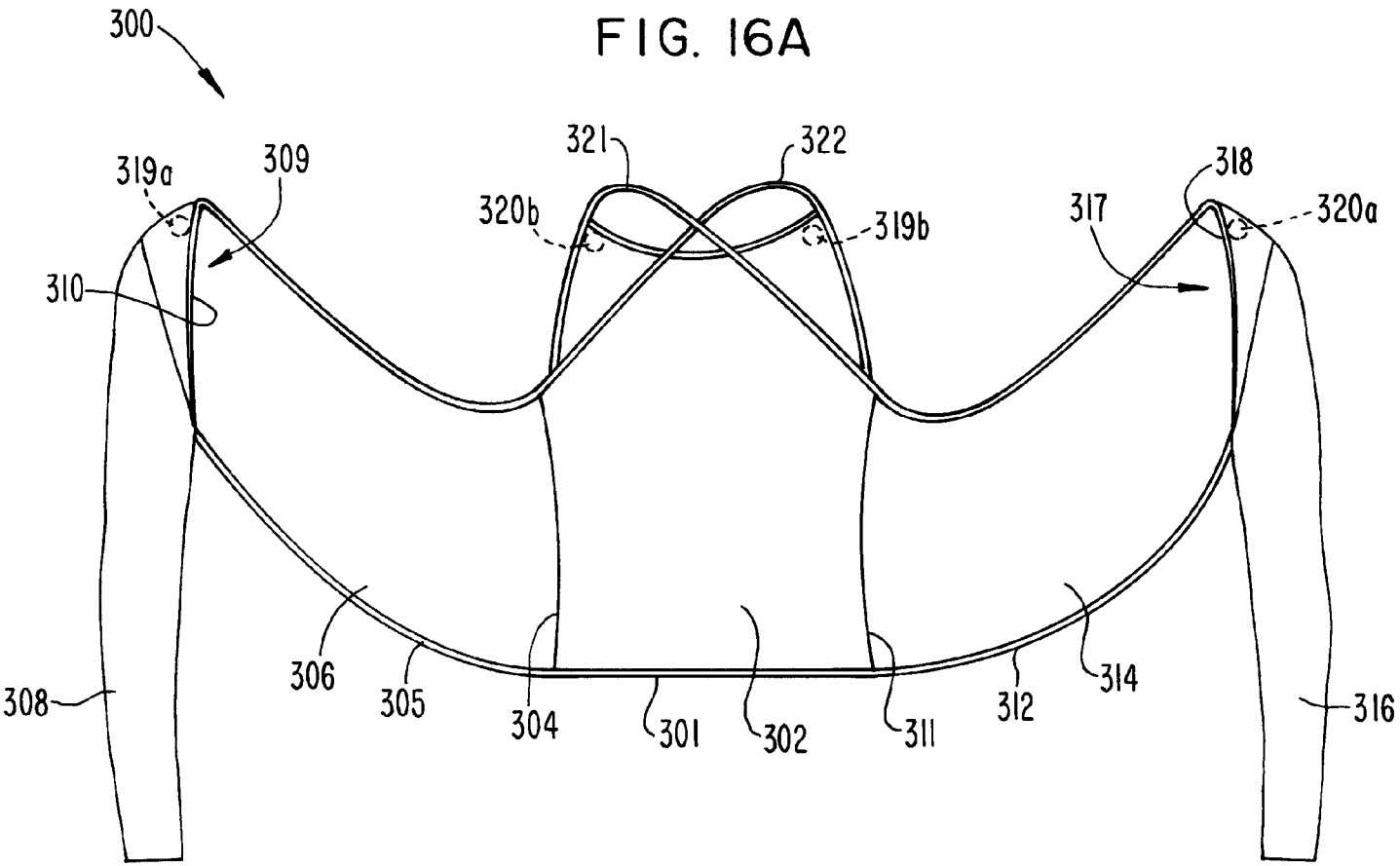
FIGS. 16A and 16B are rear and front views, respectively, of a garment according to additional embodiments of the invention
Figure 16B:
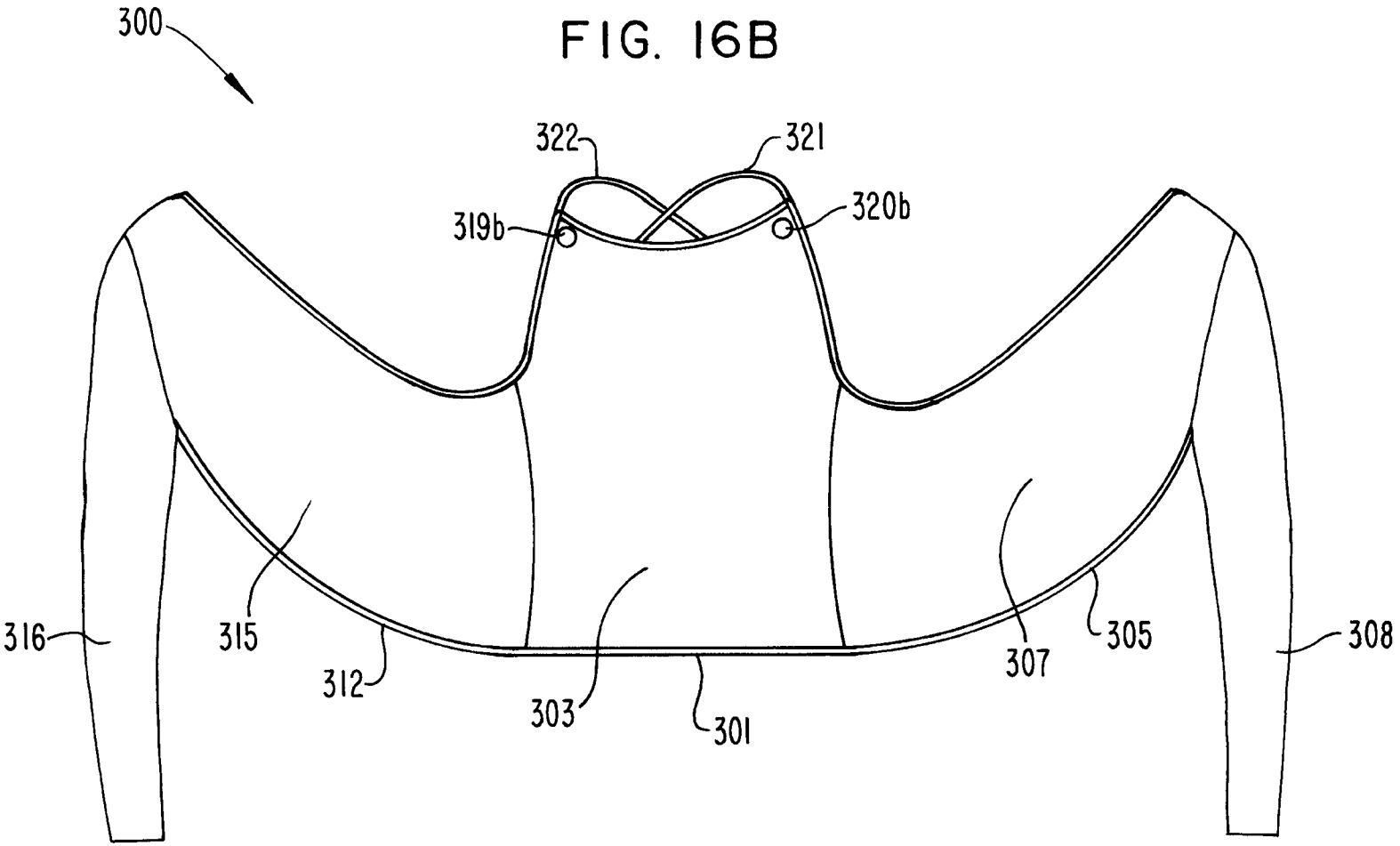

FIGS. 16A-18D show yet additional embodiments of a single garment usable under a variety of circumstances that would ordinarily require two garments. FIGS. 16A and 16B are rear and front views, respectively, of a garment 300 which can be placed into a first configuration for wear as a top with sleeves, and in a second configuration for wear as a wrap-around top without sleeves. Garment 300 is laid flat for purposes of explanation in FIGS. 16A and 16B. Garment 300 includes a front portion 301 which covers the abdomen and chest of the wearer. The inside 302 of front portion 301 is shown in FIG. 16A, and the outside 303 of front portion 301 is shown in FIG. 16B. Straps 321 and 322 connect the upper corners of front portion 301 with lower locations of front portion 301. When garment 300 is worn, each of straps 321 and 322 extends from an upper corner of front portion 301, over one of the wearer's shoulders and across one of the wearer's shoulder blades. Attached to front portion 301 at left side seam 304 is a first wrapping panel 305. First wrapping panel 305 has an inside 306 (FIG. 16A) and an outside 307 (FIG. 16B). Attached to first wrapping panel 305 is right sleeve 308. Right sleeve 308 is entered though an opening 309 having an exposed peripheral edge 310. As explained in more detail below, opening 309 and peripheral edge 310 are formed by folding over a portion of first wrapping panel 305. Attached at right side seam 311 is a second wrapping panel 312, which has an inside 314 (FIG. 16A) and an outside 315 (FIG. 16B). Attached to second wrapping panel 312 is left sleeve 316. Left sleeve 316 is entered through an opening 317 having an exposed peripheral edge 318. As explained in more detail below, opening 317 and peripheral edge 318 are formed by folding over a portion of second wrapping panel 312.

In at least some embodiments, snaps (or other type of fasteners) may also be included. For example, a first snap 319*a* could be attached to the upper inside corner of sleeve opening 309 near periphery 310. A second snap 320*a* could be attached to the upper inside corner of sleeve opening 317 near periphery 318. Mating snaps 319*b* and 320*b* could then be attached to the upper corners of front portion 301 on outside 303.

Figure 17A:
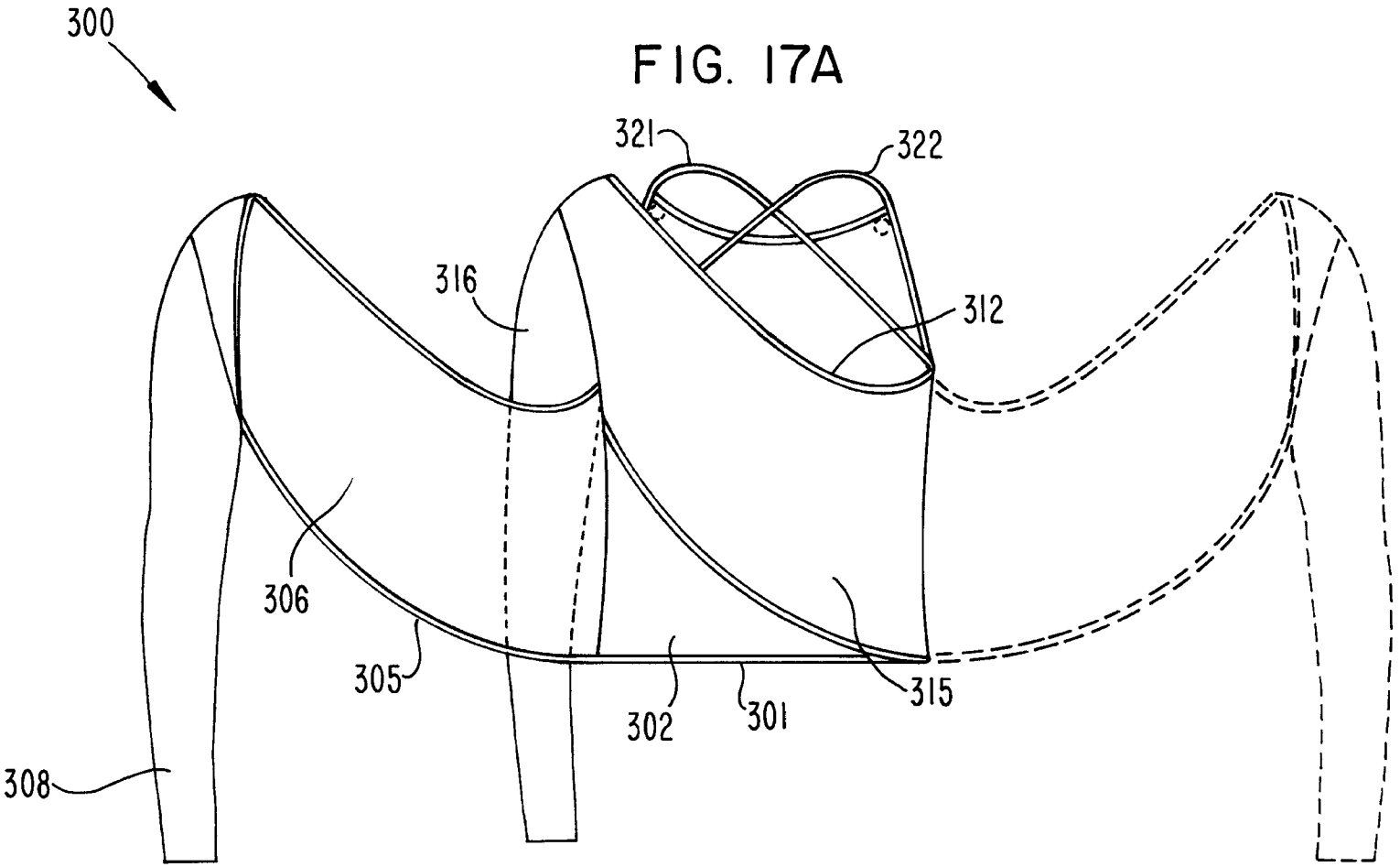
FIGS. 17A-17H show placement of the garment of FIGS. 16A and 16B into configuration for wear as a sleeved top.
Figure 17B:
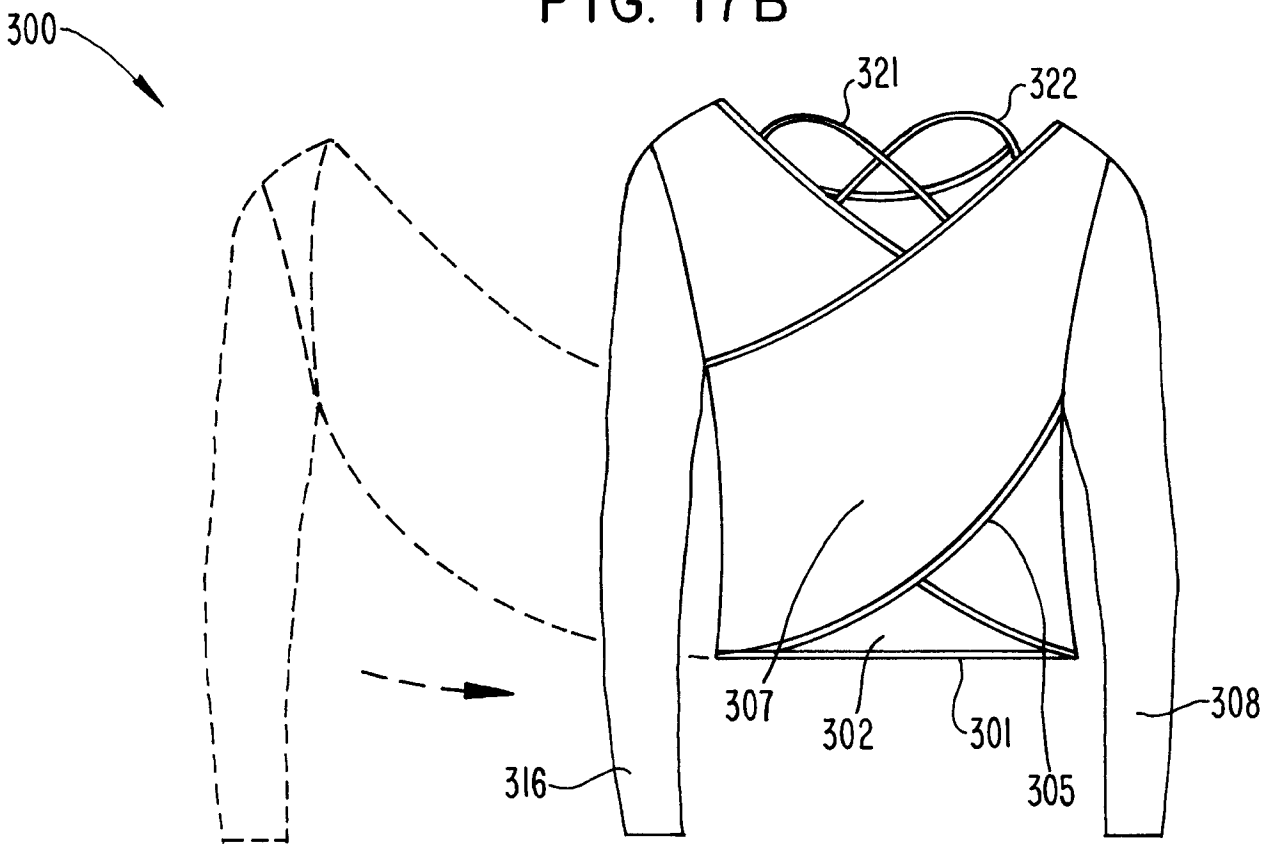
Figure 17C:
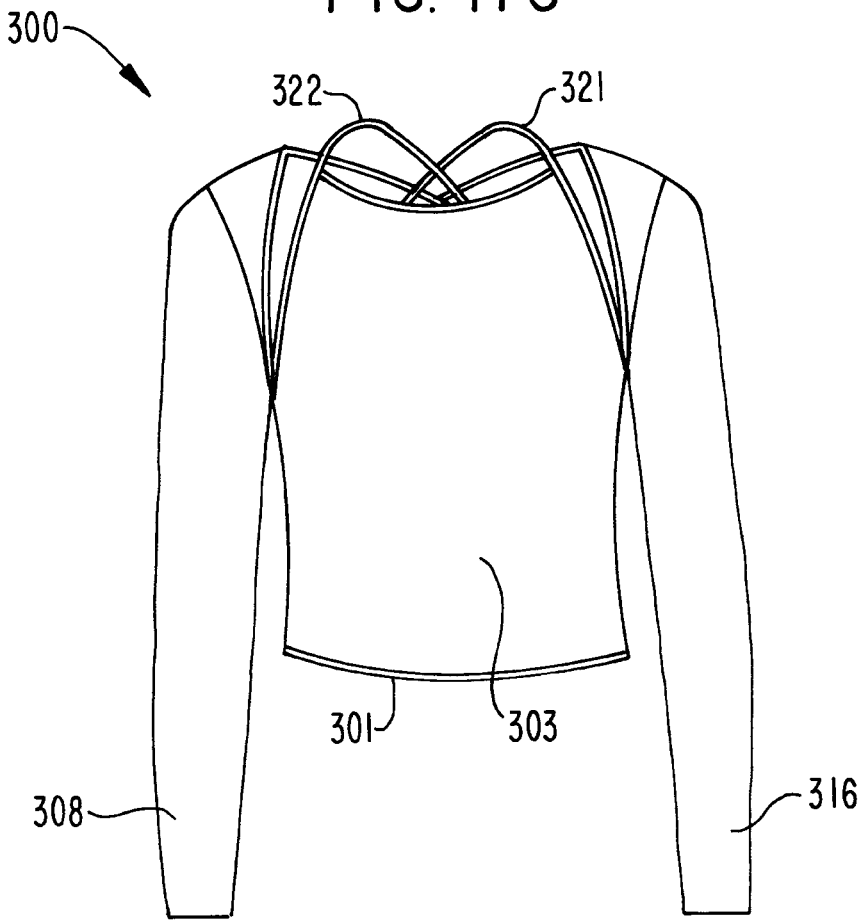
Figure 17D:
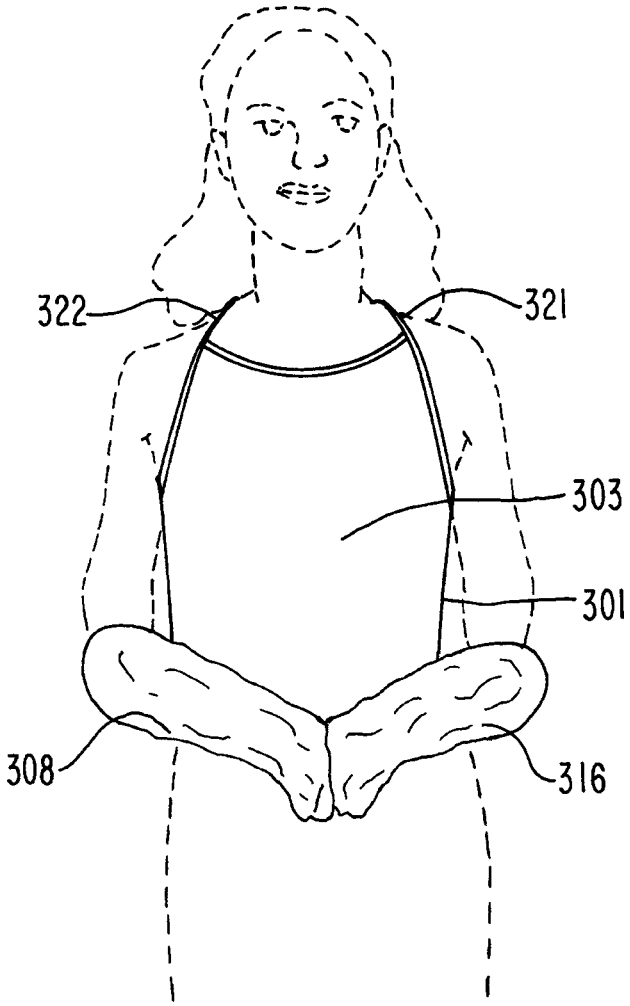
Figure 17E:
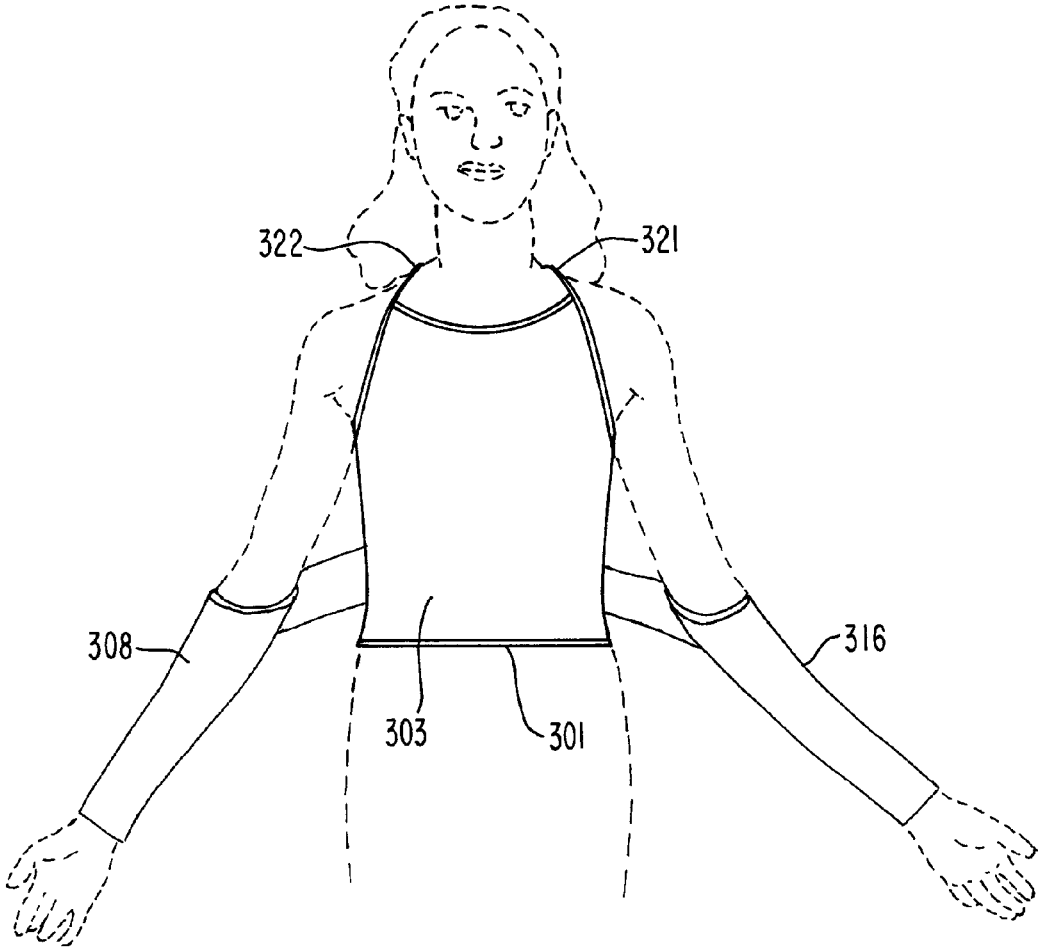
Figure 17F:
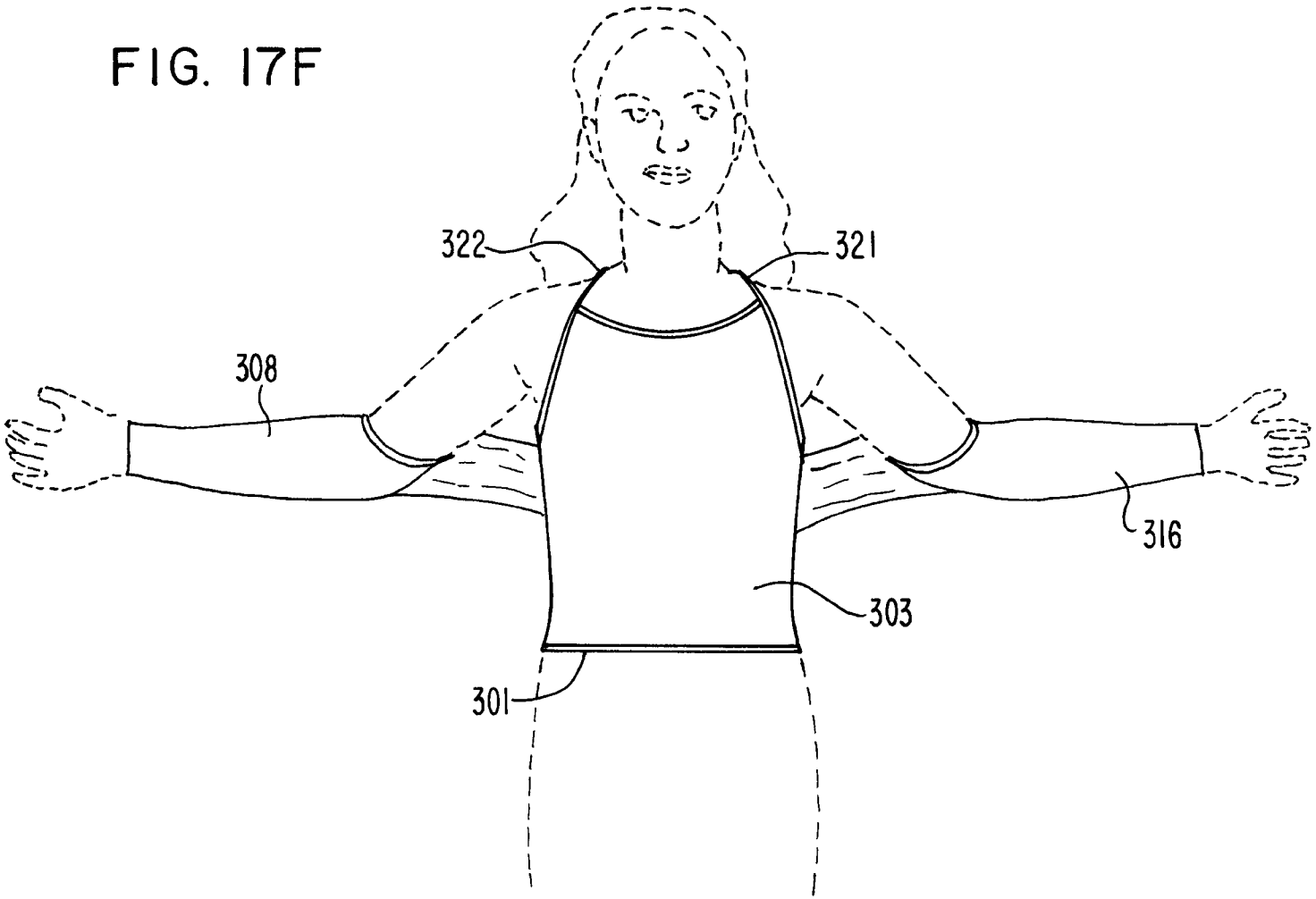
Figure 17G:
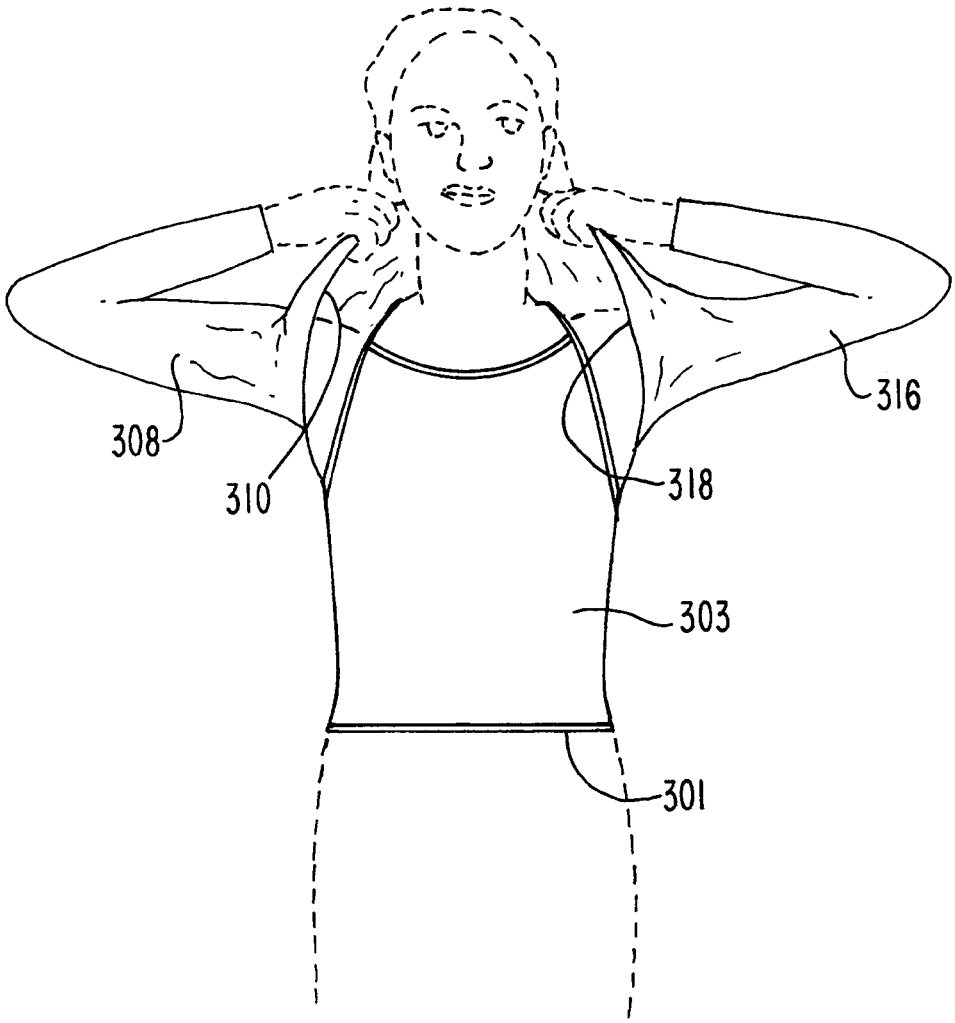
Figure 17H:
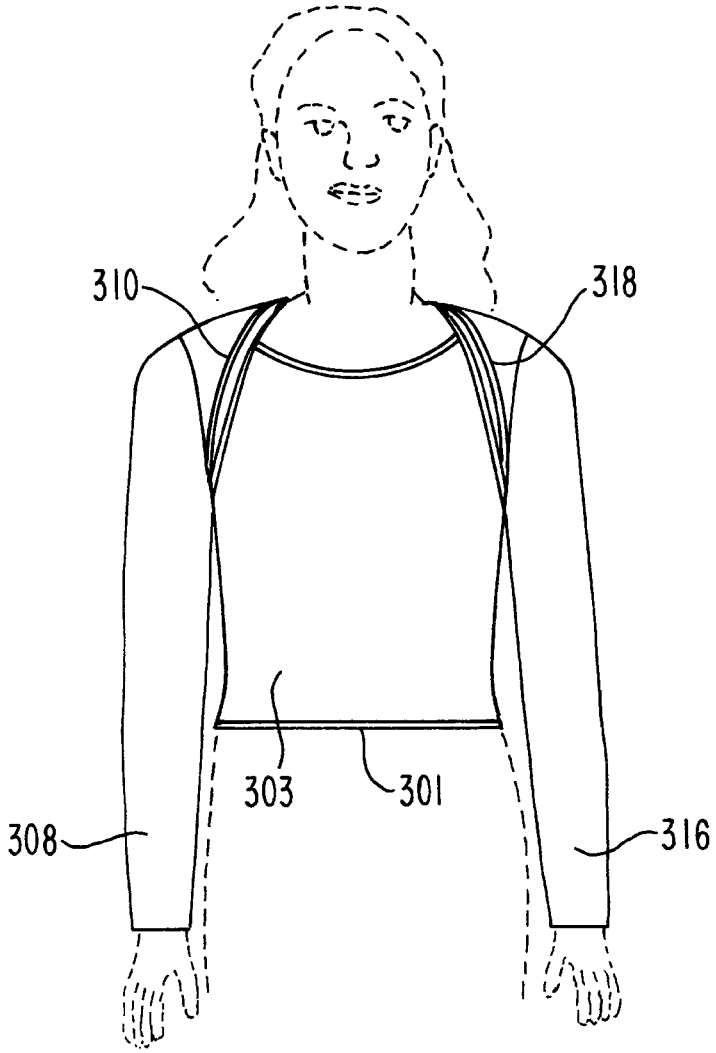

FIGS. 17A-17H show configuration of garment 300 for wear as a sleeved top. Snaps 319*a*, 319*b*, 320*a* and 320*b* are not shown in FIGS. 17A-17H. As shown in FIG. 17A, left sleeve 316 and second wrapping panel 312 are wrapped around inside 302 of front panel 301, with left sleeve 316 placed over the outside 307 of first wrapping panel 305. Next, and as shown in FIG. 17B, right sleeve 308 and first wrapping panel 305 are wrapped around second wrapping panel 312. FIG. 17C is a front view of garment 300 after the wrapping of FIGS. 17A and 17B. FIGS. 17D-17H show how the sequence of FIGS. 17A-17C may easily be performed by a wearer of garment 300. Beginning in FIG. 17D, the wearer places her head and arms through straps 321 and 322. The wearer also pulls left sleeve 316 and then right sleeve 308 around her back and begins placing her arms into sleeves 316 and 308. In FIG. 17E, the wearer has placed her arms further through sleeves 316 and 308, and is beginning to pull the upper portions of sleeves 316 and 308 to her shoulders. In FIG. 17F, the wearer has pulled the sleeves up further. In FIG. 17G, the wearer is pulling the peripheral edges 310 and 318 over her shoulders. In FIG. 17H, the wearer has finished donning garment 300.

Although FIGS. 17A-17H show configuration of garment 300 by positioning second wrapping panel 312 and left sleeve 316 and then positioning first wrapping panel 305 and right sleeve 308, the opposite order is equally possible. In other words, garment 300 could be configured such that first wrapping panel 305 is closest to the wearer's back, with second wrapping panel 312 overlapping first wrapping panel on the outside (i.e., outside 307 of first wrapping panel 305 faces inside 314 of second wrapping panel 312). The order chosen is, in at least some embodiments, a matter of wearer preference.

Figure 18A:
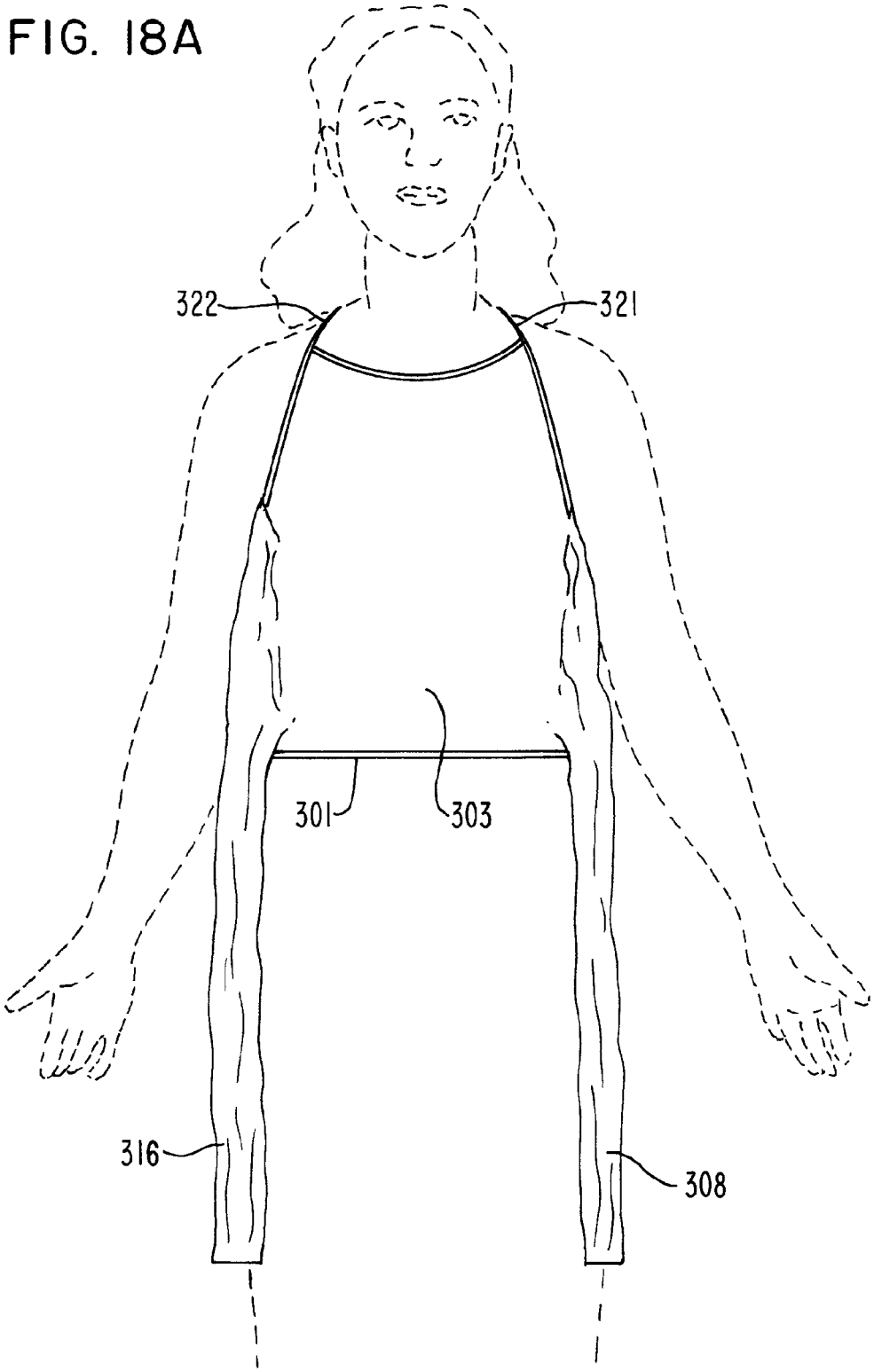
FIGS. 18A-18D show placement of the garment of FIGS. 16A and 16B into configuration for sleeveless wear.
Figure 18B:
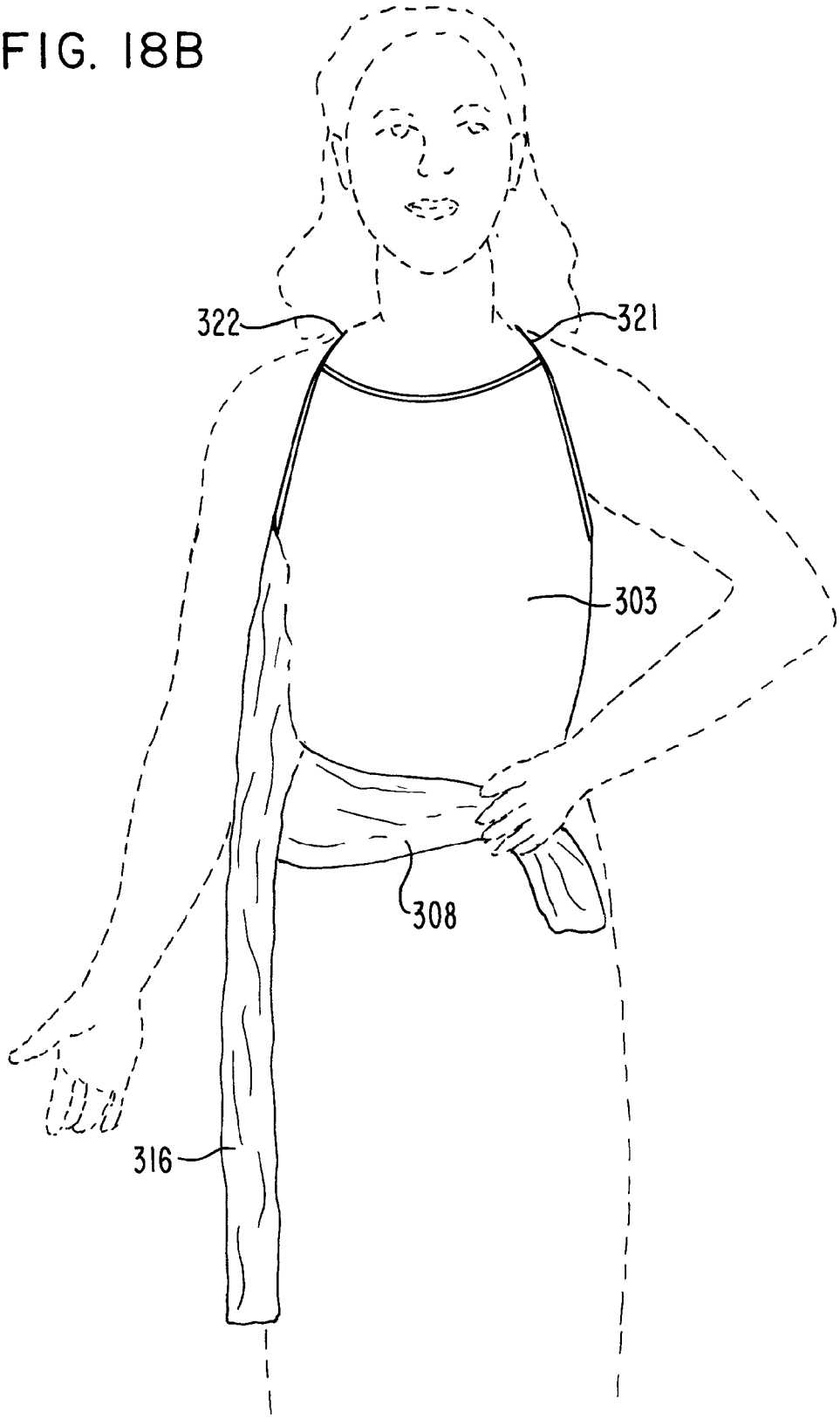
Figure 18C:
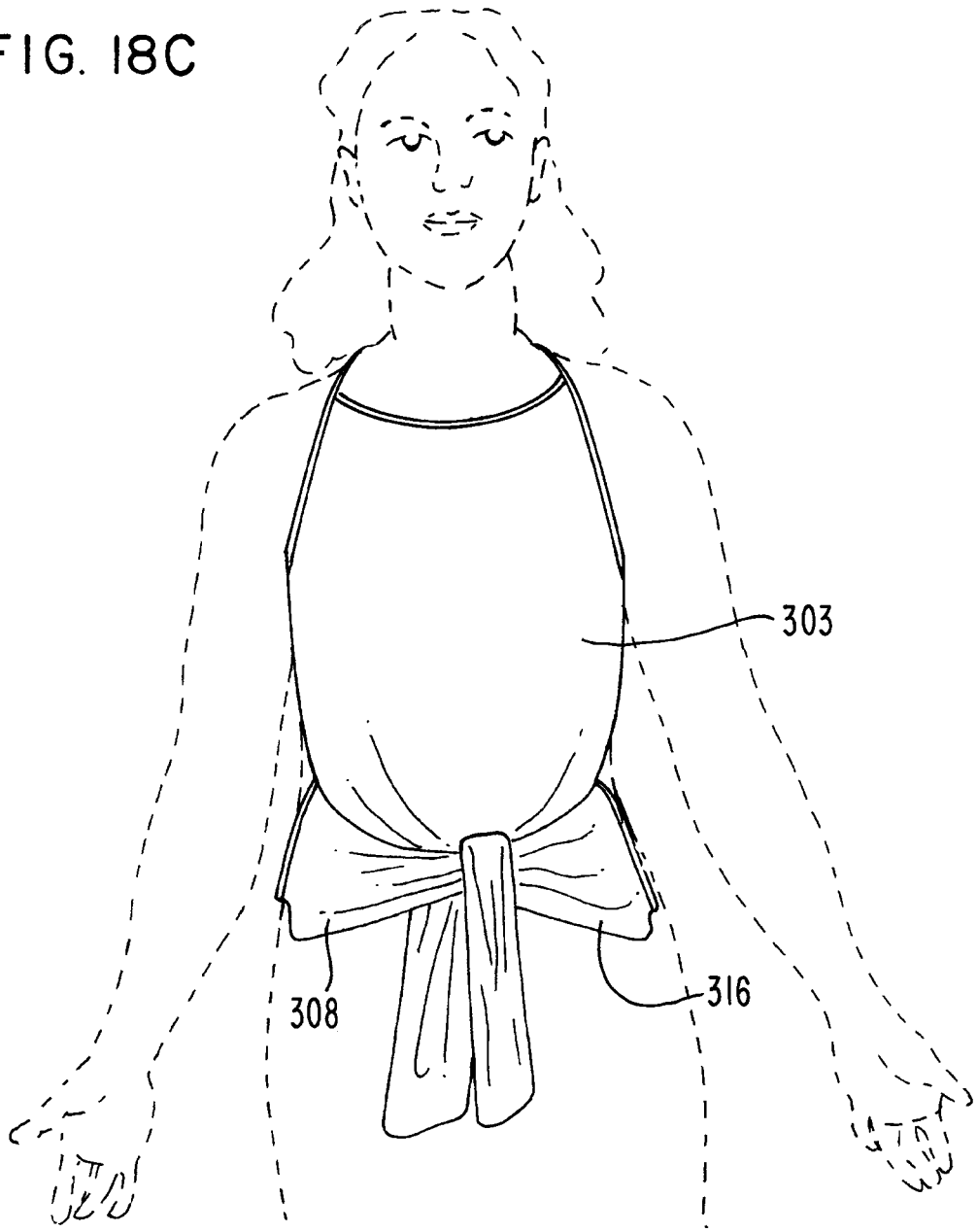
Figure 18D:
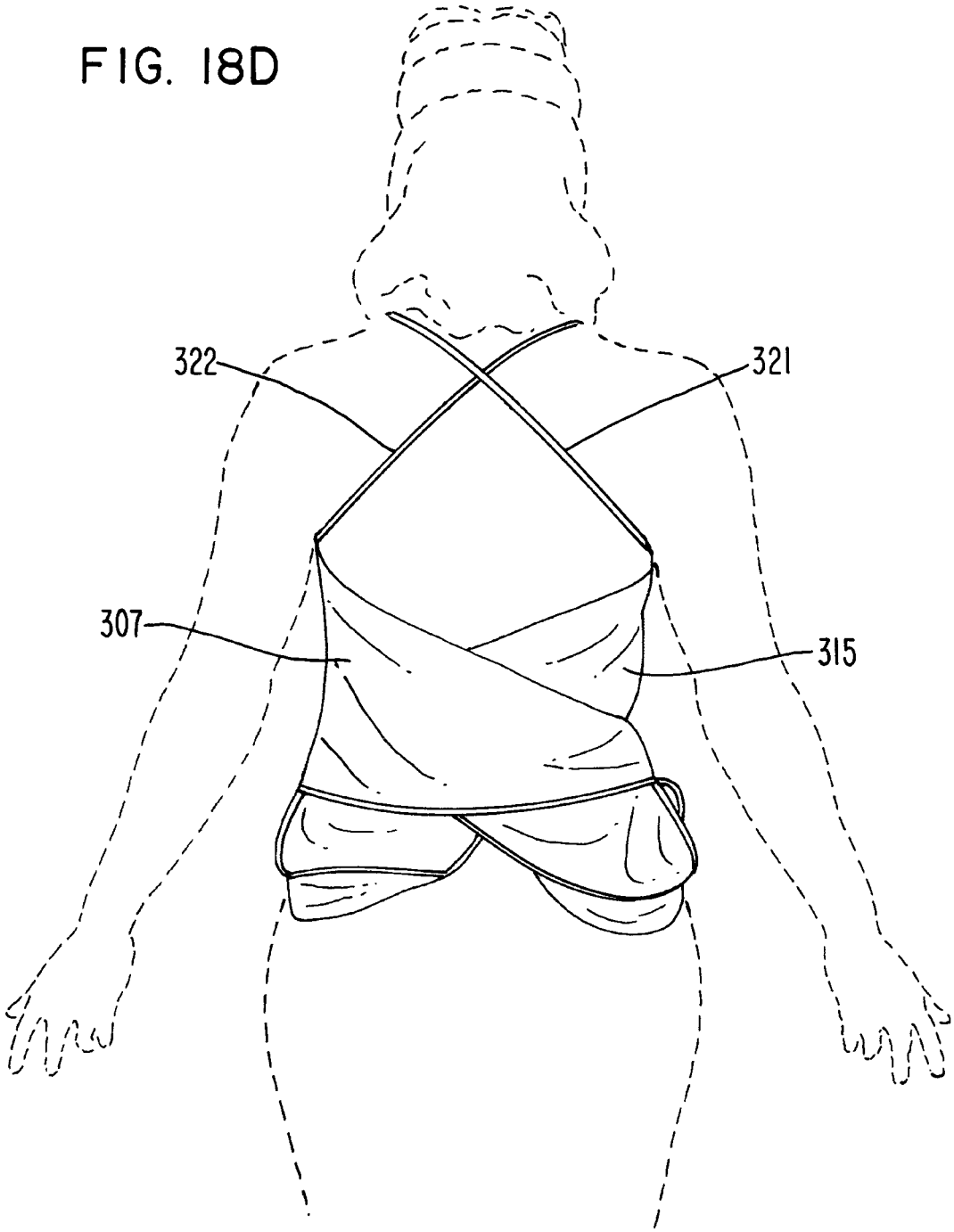

FIGS. 18A-18D show configuration of garment 300 for sleeveless wear. Snaps 319*a*, 319*b*, 320*a* and 320*b* are not shown in FIGS. 18A-18D. In FIG. 18A, similar to FIG. 17D, the wearer places her head and arms through straps 321 and 322 as shown. Sleeves 316 and 308 hang loosely at the wearer's sides. The wearer then wraps first wrapping panel 305 around her rear side (e.g., her lower back) and pulls sleeve 308 around her right side (FIG. 18B). The wearer then pulls second wrapping panel 312 around her rear side (e.g., her lower back), pulls sleeve 316 around her left side, and ties sleeve 308 and sleeve 316 in front of her body (FIG. 18C). FIG. 18D shows the wearer's back after tying sleeves 308 and 316 in front of her body. As with the configuration shown in FIGS. 17A-17H, the order in which the wearer positions first and second wrapping panels 305 and 312 in the configuration of FIGS. 18A-18D could also be reversed.

FIGS. 19A-19E show patterns for elements of garment 300 shown in FIGS. 16A-18D. FIG. 19A shows a pattern for front portion 301. FIGS. 19B and 19C, respectively, show patterns for wrapping panels 305 and 312. Wrapping panel 305 edge 351 (FIG. 19B) is joined to edge 353 of front portion 301. Wrapping panel 312 edge 355 (FIG. 19C) is joined to edge 357 of front portion 301. Edge 361 of wrapping panel 305 is then joined to region 363 at the upper end of the lower edge (FIG. 19B). In this manner, the upper curved portion of wrapping panel 305 becomes the opening 309 and peripheral edge 310 of sleeve 308 (see FIG. 16A). FIG. 19D shows a pattern for sleeve 308. Edge 365 is joined to edge 367, and the upper edge 369 is joined to edge 360 (FIG. 19B) so that points a and b on edge 369 align with points a and b on edge 360. In a similar manner, edge 371 of wrapping panel 312 is joined to region 373 at the upper end of the lower edge (FIG. 19C). In this manner, the upper curved portion of wrapping panel 305 becomes opening 317 and peripheral edge 318 of sleeve 316 (see FIG. 16A). FIG. 19E shows a pattern for sleeve 316. Edge 375 is joined to edge 377, and the upper edge 379 is joined to edge 370 (FIG. 19C) so that points c and d on edge 379 align with points c and d on edge 370. Straps 321 and 322 (not shown in FIGS. 19A-19E) may then be added.

As with the embodiments of FIGS. 1A-7C and of FIGS. 8A-15E, the embodiments of FIGS. 16A-18D are similarly not limited by type of material used. However, examples of possible materials include fabrics woven or knitted from either natural or synthetic fibers. Similarly, fasteners other then snaps could be used, or fasteners omitted altogether.

Similar to previously described embodiments, a garment such as shown in FIGS. 16A-18D is usable under a variety of circumstances that might ordinarily require a person to have two separate garments. As but one example, a woman might wear garment 300 in the sleeveless configuration when a sleeveless top is more appropriate (e.g., engaging in outdoor activities during warm weather). That woman may then convert the garment to the sleeved configuration for wear under conditions where the dress is less casual or where a sleeveless top may otherwise be less appropriate. Because the garment is convertible for use in both types of situations, the woman is not required to bring along a second garment, thereby offering substantial versatility and convenience.

While particular embodiments of the invention have been shown and described, it is recognized that various modifications thereof will occur to those skilled in the art. Therefore, the scope of the herein-described invention shall be limited solely by the claims appended hereto.

The invention claimed is:

1. A convertible garment, comprising:

a textile material section having a leftmost terminal edge, and a rightmost terminal edge, a first upper corner at a top of the leftmost terminal edge, and a second opposed upper corner at a top of the rightmost terminal edge;

a first panel having a first side and a second side, an entirety of the first side being attached to the leftmost terminal edge, the second side folded over on itself to define a first opening;

a second panel having a first side and a second side, an entirety of the first side being attached to the rightmost terminal edge, the second side folded over on itself to define a second opening;

a first strap having a first end connected to the first upper corner of the textile material section and a second end connected to the rightmost terminal edge;

a second strap having a first end connected to the second upper corner of the textile material section and a second end connected to the leftmost terminal edge;

a right sleeve attached to the first opening of the first panel; and a left sleeve attached to the second opening of the second panel, wherein the garment is configurable for wear as a sleeved top by wrapping the first panel from the left side of the wearer across a back of the wearer so as to position the right sleeve for covering at least a portion of a right arm of the wearer and wrapping the second panel from the right side of the wearer across the back of the wearer so as to position the left sleeve for covering at least a portion of a left arm of the wearer, the first and second panels being overlapped with one another;

the textile material section, the first panel, the second panel, the right sleeve, and the left sleeve are attached so as to be integrally connected to form a unitary member; and the garment is alternately configurable as a sleeveless top by wrapping the first panel from the left side of the wearer around the rear side of the wearer so as to place right sleeve in front of the wearer and wrapping the second panel from the right side of the wearer around the rear side of the wearer so as to place the left sleeve in front of the wearer in such a manner that the left and right sleeves may be tied to one another in front of the wearer.

2. The convertible garment of claim 1, further comprising:

first and second fasteners matable to secure the right sleeve in position for wear on the right arm of the wearer, and third and fourth fasteners matable to secure the left sleeve in position for wear on the left arm of the wearer.

3. The convertible garment of claim 1, wherein:

the textile material section has a lower region positioned to cover at least a portion of an abdomen of the wearer when the garment is worn, the textile material section has an upper region positioned to cover at least a portion of the chest of the wearer when the garment is worn, the first panel has a first edge attached to the leftmost terminal edge of the textile material section, a second edge attached to the right sleeve, and third and fourth curved edges connecting the first and second edges to give the first panel an arced shape curving from the lower region toward the upper region when the garment is opened and laid flat, and the second panel has a fifth edge attached to the rightmost terminal edge of the textile material section, a sixth edge attached to the left sleeve, and seventh and eighth curved edges connecting the fifth and sixth edges to give the first panel an arced shape curving from the lower region toward the upper region when the garment is opened and laid flat.

4. A convertible garment, comprising:

a textile material section having a leftmost terminal edge and a rightmost terminal edge;

a first panel having a first side and a second side, an entirety of the first side being attached to the leftmost terminal edge, a portion of the leftmost terminal edge above the first panel being exposed, the second side folded over on itself to define a first opening;

a second panel having a first side and a second side, an entirety of the first side being attached to the rightmost terminal edge, a portion of the rightmost terminal edge above the second panel being exposed, the second side folded over on itself to define a second opening;

a right sleeve attached to the first opening of the first panel; and a left sleeve attached to the second opening of the second panel;

wherein the garment is configured such that in a sleeved condition, the textile material section extends from the left side of a wearer across the wearer's chest to the right side of the wearer, the first panel extends from the left side of the wearer across the wearer's back to the right side of the wearer so as to position the right sleeve for covering at least a portion of a right arm of the wearer, and the second panel extends from the right side of the wearer across the wearer's back to the left side of the wearer so as to position the left sleeve for covering at least a portion of a left arm of the wearer, the first and second panels being overlapped with one another; and the garment is configured such that in a sleeveless condition, the textile material section extends from the left side of the wearer across the wearer's chest to the right side of the wearer, the first panel extends from the left side of the wearer across the wearer's back to a right side of the wearer so as to place the right sleeve in front of the wearer, and the second panel extends from the right side of the wearer across the wearer's back to the left side of the wearer so as to place the left sleeve in front of the wearer in such a manner that the left and right sleeves may be tied to one another in front of the wearer.

5. The convertible garment of claim 4, further comprising:

first and second fasteners matable to secure the right sleeve in position for wear on the right arm of the wearer, and third and fourth fasteners matable to secure the left sleeve in position for wear on the left arm of the wearer.

6. The convertible garment of claim 4, further comprising at least one strap extending from a first location on the textile material section to a second location on the textile material section, and positioned to extend over a shoulder of the wearer when the garment is worn.

7. The convertible garment of claim 4, wherein:

the textile material section has a lower region positioned to cover at least a portion of an abdomen of the wearer when the garment is worn, the textile material section has an upper region positioned to cover at least a portion of the chest of the wearer when the garment is worn, the first panel has a first edge attached to the leftmost terminal edge of the textile material section, a second edge attached to the right sleeve, and third and fourth curved edges connecting the first and second edges to give the first panel an arced shape curving from the lower region toward the upper region when the garment is opened and laid flat, and the second panel has a fifth edge attached to the rightmost terminal edge of the textile material section, a sixth edge attached to the left sleeve, and seventh and eighth curved edges connecting the fifth and sixth edges to give the first panel an arced shape curving from the lower region toward the upper region when the garment is opened and laid flat.

* * * * *